US010206035B2

(12) United States Patent
Lai et al.

(10) Patent No.: US 10,206,035 B2
(45) Date of Patent: Feb. 12, 2019

(54) SIMULTANEOUS SOLUTION FOR SPARSITY AND FILTER RESPONSES FOR A MICROPHONE NETWORK

(71) Applicant: University of Maryland, College Park, MD (US)

(72) Inventors: Yenming Mark Lai, College Park, MD (US); Radu Victor Balan, Rockville, MD (US)

(73) Assignee: University of Maryland, College Park, MD (US)

( * ) Notice: Subject to any disclaimer, the term of this patent is extended or adjusted under 35 U.S.C. 154(b) by 0 days.

(21) Appl. No.: 15/252,373

(22) Filed: Aug. 31, 2016

(65) Prior Publication Data

US 2017/0064478 A1 Mar. 2, 2017

Related U.S. Application Data

(60) Provisional application No. 62/212,147, filed on Aug. 31, 2015.

(51) Int. Cl.
*H04R 3/00* (2006.01)
*H04R 5/027* (2006.01)
*H04R 1/40* (2006.01)

(52) U.S. Cl.
CPC ..... *H04R 3/005* (2013.01); *H04R 5/027* (2013.01); *H04R 1/406* (2013.01)

(58) Field of Classification Search
CPC ..... H04R 3/005; H04R 5/027; H04R 1/406
USPC ..... 381/92, 58
See application file for complete search history.

(56) References Cited

U.S. PATENT DOCUMENTS 8,942,387 B2 * 1/2015 Elko ..... H04R 3/005 381/92
2003/0233213 A1 12/2003 Balan et al.
2010/0241428 A1 * 9/2010 Yiu ..... H04R 3/005 704/233
2012/0314885 A1 * 12/2012 Rasmussen ..... H04R 3/005 381/92
2014/0098964 A1 4/2014 Rosca et al.
2014/0270202 A1 * 9/2014 Ivanov ..... H04R 29/005 381/58
2014/0314251 A1 10/2014 Rosca et al.

OTHER PUBLICATIONS

Ward et al., "Grid-based beamformer design for room-environment microphone arrays", Proc. 1999 IEEE; Oct. 1999.*

(Continued)

*Primary Examiner* — David Ton

(57) ABSTRACT

Placement of microphones and design of filters in a microphone network are solved simultaneously. Using filterbanks with multiple sub-channels for each microphone, the design of the filter response is solved simultaneously with placement. By using an objective function that penalizes the number of sub-channels in any solution, only some of many possible sub-channels and corresponding microphones and filters are selected while also solving for the filter responses for the selected sub-channels. For a given target location, the location of the microphones and the filter responses to beamform are optimized.

20 Claims, 12 Drawing Sheets

(56) References Cited

OTHER PUBLICATIONS

Andrea Trucco and Vittorio Murino. Stochastic optimization of linear sparse arrays. Oceanic Engineering, IEEE Journal of, 24(3):291-299, 1999.

Dragana Bajovic, Bruno Sinopoli, and Joo Xavier. Sensor selection for event detection in wireless sensor networks. Signal Processing, IEEE Transactions on, 59(10):4938-4953, 2011.

Eric Viscito and Jan P Allebach. The analysis and design of multidimensional fir perfect reconstruction filter banks for arbitrary sampling lattices. Circuits and Systems, IEEE Transactions on, 38(1):29-41, 1991.

Giacomo Oliveri and Andrea Massa. Bayesian compressive sampling for pattern synthesis with maximally sparse non-uniform linear arrays. Antennas and Propagation, IEEE Transactions on, 59(2):467-481, 2011.

Ha Hoang Kha, Hoang Duong Tuan, and Truong Q Nguyen. Efficient design of cosinemodulated filter banks via convex optimization. Signal Processing, IEEE Transactions on, 57(3):966-976, 2009.

J. L. Araque Quijano, M. Righero, and G. Vecchi. Sparse 2-d array placement for arbitrary pattern mask and with excitation constraints: A simple deterministic approach. Antennas and Propagation, IEEE Transactions on, 62(4):1652-1662, 2014. 0018-926X.

James D Johnston. A filter family designed for use in quadrature mirror filter banks. In Acoustics, Speech, and Signal Processing, IEEE International Conference on ICASSP'80., vol. 5, pp. 291-294. IEEE.

JianWang, Wei-Xing Sheng, Yu-Bing Han, and Xiao-Feng Ma. Adaptive beamforming with compressed sensing for sparse receiving array. Aerospace and Electronic Systems, IEEE Transactions on, 50(2):823-833, 2014.

Ling Cen, Wee Ser, Zhu Liang Yu, Susanto Rahardja, and Wei Cen. Linear sparse array synthesis with minimum number of sensors. Antennas and Propagation, IEEE Transactions on, 58(3):720-726, 2010.

Shuichi Ohno and Hideaki Sakai. Optimization of filter banks using cyclostationary spectral analysis. Signal Processing, IEEE Transactions on, 44(11):2718-2725, 1996.

Siddharth Joshi and Stephen Boyd. Sensor selection via convex optimization. Signal Processing, IEEE Transactions on, 57(2):451-462, 2009.

Siew Eng Nai, Wee Ser, Zhu Liang Yu, and Huawei Chen. Beampattern synthesis for linear and planar arrays with antenna selection by convex optimization. Antennas and Propagation, IEEE Transactions on, 58(12):3923-3930, 2010.

Timothy Davidson. Enriching the art of fir filter design via convex optimization. Signal Processing Magazine, IEEE, 27(3):89-101, 2010.

Tongwen Chen and BA Francis. Design of multirate filter banks by h optimization. IEEE Transactions on Signal Processing, 43:2822-2830, 1995.

Truong Q Nguyen. Digital filter bank design quadratic-constrained formulation. Signal Processing, IEEE Transactions on, 43(9):2103-2108, 1995.

Venkat Roy, Sundeep Prabhakar Chepuri, and Geert Leus. Sparsity-enforcing sensor selection for doa estimation. In Computational Advances in Multi-Sensor Adaptive Processing (CAMSAP), 2013 IEEE 5th International Workshop on, pp. 340-343. IEEE.

Zhi Guo Feng, Ka Fai Cedric Yiu, and Sven E Nordholm. Placement design of microphone arrays in near-field broadband beamformers. Signal Processing, IEEE Transactions on, 60(3):1195-1204, 2012.

* cited by examiner mic 29 of 31

SIMULTANEOUS SOLUTION FOR SPARSITY AND FILTER RESPONSES FOR A MICROPHONE NETWORK

CROSS REFERENCE TO RELATED APPLICATIONS

The present application claims the benefit of U.S. Provisional Patent Application Ser. No. 62/212,147, filed on Aug. 31, 2015, which is incorporated herein by reference in its entirety.

GOVERNMENT INTERESTS

One or more aspects described herein were supported by the National Science Foundation (NSF) under contract numbers DMS-1109498 and 1440493. The U.S. Government may have certain rights in the claimed inventions.

BACKGROUND

The present embodiments relate generally to microphone networks. In particular, the location of microphones and filter responses to use for maintaining signal from a target while reducing influence from interference sources is determined.

There has been extensive work in the sensor placement problem using a variety of strategies. In design or selection of already implemented microphone arrays, the position of the selected microphones is solved using various approaches. Simulated annealing may be used to simultaneously optimize both weights and sensor locations on a linear array. Sensor location may be found using convex optimization. A binary variable of a sensor being off, 0, or on, 1, is relaxed by letting the variable instead be in the range of [0, 1]. In another relaxation, the unknown vector is converted to a matrix of 0s and 1s that belong to the class of Steifel matrices. The relaxation is to a 1-d sphere, and multiple dimensions are found using a greedy algorithm. Objective criteria are optimized using the KullbackLeibler divergence.

There has also been extensive work in the optimization of filterbanks. For example, a quadrature mirror filterbank is optimized to meet a user-given frequency response criteria. The ripple energy and out of band energy are minimized using a search algorithm whose success is highly dependent on both the starting point and step size. In another example, analysis filters at the microphones are fixed, and the synthesis filters prior to summation are optimized to achieve the best possible reconstruction given a user-specified integer time delay. The problem is converted to a $H_1$ problem to take advantage of existing software. In yet another example, a multi-dimensional perfect reconstruction filterbank has both the analysis and synthesis filter as FIR filters of equal length. This non-linear and non-convex constraint is embedded directly into the optimization where the objective function measures the difference between a desired analysis filterbank and the optimized analysis filterbank.

With both placement and filter response criteria, it may be difficult or time consuming to determine microphone placement as well as filter response while still meeting the criteria of both decisions.

SUMMARY

By way of introduction, the preferred embodiments described below include methods, systems, and computer readable media for placement of microphones and design of filters in a microphone network. Using filterbanks with multiple sub-channels for each microphone, the design of the filter response is solved simultaneously with placement. By using an objective function that penalizes the number of sub-channels in any solution, only some of many possible sub-channels and corresponding microphones and filters are selected while also solving for the filter responses for the selected sub-channels. For a given target location, the location of the microphones and the filter responses to beamform are optimized.

In a first aspect, a method is provided to place microphones and design filters in a microphone network. Possible locations for the microphones of an array of the microphone network are determined in a region. Two or more sub-channels are assigned for each of the possible locations, and a filter is assigned for each of the sub-channels. For a target source in the region, a sub-set of the possible locations and filter responses for the filters of the sub-channels of the sub-set are solved. The solutions for the sub-set of the possible locations and the filter responses for the sub-set being are simultaneous. The filter responses for the sub-set are linked to the microphones at the possible locations of the sub-set.

In a second aspect, a system is provided for placing microphones and designing filters. A processor is configured to determine possible locations for the microphones of an array of the microphone network in a region, assign two or more sub-channels for each of the possible locations and a filter for each of the sub-channels, and, for a target source in the region, solving for a sub-set of the possible locations and filter responses for the filters of the sub-channels of the sub-set. The solutions for the sub-set of the possible locations and the filter responses for the sub-set are simultaneous. A memory is configured to store the filter responses for the sub-set and the possible locations of the sub-set.

In a third aspect, a system is provided to filter microphone signals. A plurality of beamformer channels each include a microphone, a first filter having at least two sub-channels, a communication network connecting output of the sub-channels to second filters, and the second filters configured to filter the outputs of the sub-channels of the first filters where filter responses of the second filters are from a simultaneous solution of location of the microphones and the filter responses. A summer is configured to sum outputs from the beamformer channels.

The present invention is defined by the following claims, and nothing in this section should be taken as a limitation on those claims. Further aspects and advantages of the invention are discussed below in conjunction with the preferred embodiments and may be later claimed independently or in combination.

DETAILED DESCRIPTION

Figure 1:
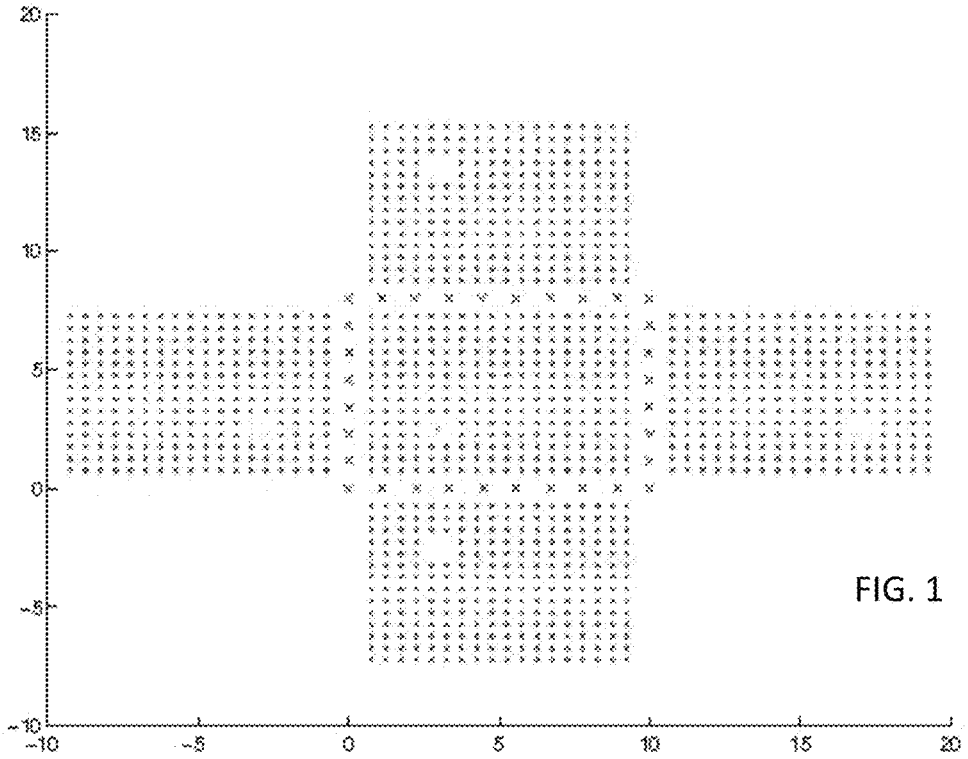
FIG. 1 illustrates an example room with thirty-two possible microphone locations relative to a target location.

Given a fixed number of sensors, optimization is used to determine a best possible beam pattern. The placement of the fixed number of sensors is simultaneously solved as part of the optimization. A sensing system may use a large number of N sensors (microphones) placed in multiple dimensions to monitor an acoustic field. Using and/or implementing all the microphones at once is impractical because of the amount data generated. Instead, a sub-set of D microphones is selected to be active. The D set (i.e., sub-set of N) of microphones that minimizes the largest interference gain at multiple frequencies while monitoring a target of interest is determined. A direct, combinatorial approach—testing all N to choose D subsets of microphones—is impractical because of the problem size. Instead, a convex optimization induces sparsity through a l1-penalty to determine which subset of microphones to use. Not only the optimal placement (i.e., location in space) of microphones is determined, but also how to process the output of each microphone (e.g., in time and/or frequency) is optimized.

The output of each of the N microphones is processed by an individual multirate filterbank, providing C sub-channels for separately processing the microphone signals. The N processed filterbank outputs are then combined to form one final signal. In this approach, the analysis filters implemented locally to the microphones are fixed, and the optimization is over all the synthesis filters applied to the outputs of the analysis filters. The continuous frequency problem is converted to a discrete frequency approximation that is computationally tractable for the optimization. In this random source/multirate filterbank case, the optimization is over space-time-frequency simultaneously. Not only choosing the placement of microphones but also how to process each of the microphones sampled signals is optimized to monitor a target while attenuating other interfering sources.

The audio systems are designed or used to monitor targets in complex environments. Industrial environments may use the audio system. For example, engineering managers are interested in monitoring specific bearings on a wind turbine, car manufacturers are interested in the sound of a specific piston, or train conductors are interested in detecting aberrant sounds in a specific wheel set. The optimization provides for the audio system to monitor specific locations while reducing signal from interference sources at other locations. The audio system may operate where microphones cannot be placed adjacent to the target of interest, where a quiet or interference-free environment does not exist, and/or where the interference sources' location and signature are not known. A large number of interferences with known locations or a small number of interferences with unknown locations may be modeled. In addition, a limited number of microphones is possible due to bandwidth or other constraints. Other environments than industrial may benefit from the audio system, such as medical, acoustic monitoring, sonography, or surveillance.

To make the problem computationally tractable, possible microphone locations are discretized so that there is a finite set of possible microphone locations. Choosing a reduced number of microphone locations from a set of possible microphone locations is a combinatorial problem, and, for even a moderate size problem, the number of possibilities may be overwhelming.

In one embodiment, the p-norm of interference source gains is minimized while both reconstructing perfectly the target source and using a sparse number of sub-channels of the filterbanks of the microphones. In the problem model, there are two types of sources: interferences, l, whose gains are to be attenuated and a single target, whose gain from system processing is to be exactly equal to 1. In other words, the system processes the target source with no distortion, but embodiments allowing for some distortion of the target may be provided. In one example representation, the optimization of the filter responses, G, is represented as:

$$\min_{G_{n,D\times C}(e^{j\omega})} \left\| \left\{ \left\| \sum_{n=0}^{N-1} G_{n,D\times C}(e^{j\omega}) F_{n,C\times D}(e^{j\omega}) H^{(r)}_{n,D\times D}(e^{j\omega}) \right\|_2^2 \right\}_{1\le r\le L} \right\|_p \tag{1}$$

$$\text{subject to } \sum_{n=0}^{N-1} G_{n,D\times C}(e^{j\omega}) F_{n,C\times D}(e^{j\omega}) H^{(0)}_{n,D\times D}(e^{j\omega}) = De^{j\omega}\mathrm{diag}\left[\left(e^{-\frac{2\pi jd}{D}}\right)_{d=0}^{D-1}\right]$$

$$\sum_{n=0}^{N-1} \left\| \left\{ \max_{-\pi\le\omega\le\pi} \left| (G_{n,D\times C}(e^{j\omega}))_{0,l} \right| \right\}_{0\le l\le C-1} \right\|_0 \le V_S$$

where $H^{(r)}_{n,D\times D}(e^{j\omega})$ refers to the product of two frequency domain objects: the propagation of source r to microphone n and the target inversion filter specific to microphone n, D is a signal decimation factor, C is the number of sub-channels per filterbank, and $V_S$ is the desired number of active sub-channels. Unfortunately, this is not a convex optimization problem. The set of N·C analysis filters, denoted by F, may be fixed and known where N is the number of microphones and C is the number of sub-channels for each microphone, resulting in:

$$F = (F_{n,l}(e^{j\omega}))_{\substack{0\le n\le N-1 \\ 0\le l\le C-1 \\ \omega\in[0,2\pi)}} \tag{2}$$

being a known quantity.

The locations of the sources and microphones are assumed. A separate audio system (i.e., microphone placement or selection and filter responses for the selected microphones) is designed or determined for different target source locations, allowing scanning of a region by sequentially or simultaneous application of different audio systems. By fixing or assuming the locations of the sources and the microphones, the cascade or product, denoted by H, of the source propagation and target inversion filters is also known. This image model defines the possible locations for microphones, a sub-set of which are selected in optimization. There are l+1 sources with the interferences and a single target source and N microphones. Hence, H has (l+1)·N transfer functions. H may be defined as follows $$H = (H_{r,n}(e^{j\omega}))_{\substack{0\le r\le l \\ 0\le n\le N-1 \\ \omega\in[0,2\pi)}} \tag{3}$$

The optimization is then defined over the N·C synthesis filters, denoted by the filter response G, where G is defined as follows:

$$G = (G_{n,l}(e^{j\omega}))_{\substack{0\le n\le N-1 \\ 0\le l\le C-1 \\ \omega\in[0,2\pi)}} \tag{4}$$

To make finding the unknown G computationally tractable, the continuous variable for frequency, w, $0\le w<2\pi$, is discretized with $N_f$ equally spaced frequency points. This is represented as:

$$w = \frac{2\pi f}{N_f} \text{ with } f = 0, 1, \ldots, N_f - 1 \tag{5}$$

To simplify the computations, the number of discretized frequencies, $N_f$, is treated as an even multiple of D (the down sampling factor). That is:

$$N_f = M \cdot D \tag{6}$$

with M a positive even integer. In addition, to vectorize the computations, the indexes n (number of microphones) and l (sub-channel) over index, s (for sub-channels) are set by letting $$s = l + nC \text{ and } S = N \cdot C \tag{7}$$

Hence, the discretized version of unknown synthesis filters G, $G_{compute}$, has $S \cdot N_f$ unknown complex numbers, that is:

$$G_{compute} = \left(G_{n,l}\left(e^{j\left(\frac{2\pi}{N_f} f\right)}\right)\right)_{\substack{0 < s < S-1 \\ 0 \le f \le N_f - 1}} \tag{8}$$

By penalizing non-zero sub-channel synthesis tap coefficients in the optimization problem with an absolute value penalty term, in the spirit of the LASSO algorithm, certain sub-channels are forced to be considered inactive, creating a sparse set of active sub-channels. A sub-channel is considered inactive if the synthesis tap coefficients are zero or close to zero, such as a threshold amount from zero.

In the optimization, the gain of the interference and source are calculated. Any measure of gain may be used. In one example, the gain is measured as a time-averaged energy assuming a fixed source x. The gain is computed for each of the l+1 sources, $x_r$. The objective function of the optimization includes two terms, the p-norm of interference source gains and the sparse sub-channel penalty term.

FIG. 1 shows one embodiment a region being monitored by microphones. The region in this example is a room, 10 meters by 8 meters, but other room sizes and/or types of regions may be monitored. The lower left hand corner of the room is defined as the origin, coordinate (0,0). FIG. 1 shows a two-dimensional representation, but distribution in three dimensions may be provided.

The target is at one given location, (3, 2.5) in this example. The audio system is optimized for a target source at this location. The target is an acoustic source of interest. For other target locations, other audio systems are separately optimized. The multiple audio systems may then be used to monitor the room. For example, a scan is performed by applying different audio systems and analyzing the output signals. If the output signal of one audio system has desired characteristics, the target location for that audio system is identified as the location of the target source at that time.

In FIG. 1, the dots represent interference sources of an image model. The interference represents any acoustic source that is not of interest, so is to be suppressed in the selection or placement of sub-channels and the design of the filter responses for the selected sub-channels. There are 1240 virtual interferences in this example. The room environment is modeled using a large number of virtual interferences since the location of actual interference sources is not a priori known. The interference sources are modeled within the region as well as reflected from walls, so modeled as outside the region. Four-fifths of the interferences lie outside the room and model reflections off the four walls. Other arrangements or models of interference may be provided, including different resolution and/or non-uniform distribution.

The microphones are shown as being in any of 32 possible locations possible locations, x, distributed uniformly along the walls of the room. Other numbers of possible locations may be provided, such as tens, hundreds, or thousands. Non-uniform spacing and/or possible locations in the interior may be used. Each possible location, x, represents a location of any number of sub-channels, such as two sub-channels for each location, resulting in 64 total sub-channels.

The optimization may be for selection of existing microphones. For example, FIG. 1 represents an existing array. Alternatively, the optimization is for design of an array to be installed. The placement of microphones to monitor the desired target source locations and corresponding filter responses to isolate the signals from those target locations is found through optimization so that microphones are installed at desired locations and not other possible locations. An optimal microphone spacing is dependent on frequencies of the sources and the optimal microphone location is dependent on the unknown source locations. Also, there may be practical constraints in each application (e.g., it is not possible to put microphones in certain locations or there might be wiring problems). In one embodiment, a uniform distribution of microphones in a space is applied, for instance around the walls of a space such as a room, or in a grid throughout a ceiling. In another embodiment, the possible locations for microphones are arranged in a random or logarithmic fashion on either the walls or in 2D on the ceiling or floor of the room.

Figure 2:
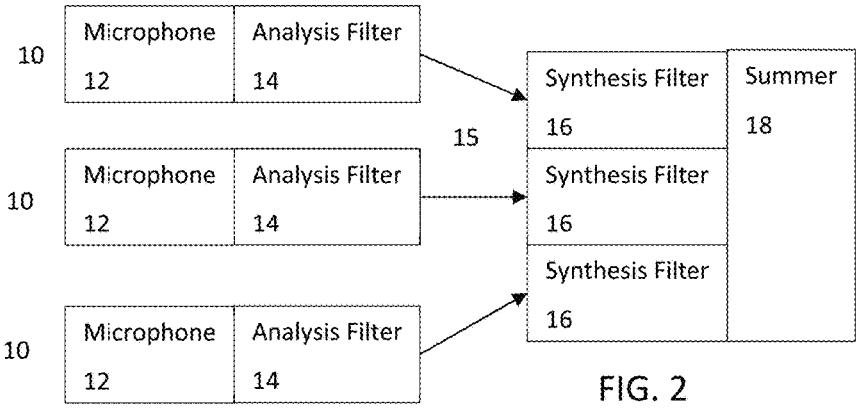
FIG. 2 illustrates a system for using determined microphone placement and filter responses according to one embodiment.

FIG. 2 shows one embodiment of a system to filter microphone signals. The system is an audio system, such as an acoustic beamformer for isolating signals from a target location using an array of microphones 12. Interference signals from interference sources or locations other than the target or targets are attenuated. The system uses microphone 12 placement and filter responses optimized simultaneously. Either the microphones 12 are placed based on the optimization (i.e., the actual microphones 12 make up the selected sub-set), some of the microphones 12 as placed are selected and others are not based on the optimization, or combinations thereof (e.g., microphone 12 placement is determined by optimization for multiple audio systems and only some of the existing microphones 12 are selected for implementing a given optimized audio system).

FIG. 2 shows three beamformer channels 10 and a summer 18 of an audio system to be optimized or after optimization. More or fewer channels 10 may be provided. For example, there are tens, hundreds, or thousands of channels 10. Each channel 10 connects to a separate microphone. In other embodiments, more than one channel 10 connects to a same microphone, such as to process the same signals differently.

Additional, different, or fewer components may be provided. For example, a server, computer, or processor connects with the output of the summer 18. The output is a combined signal with attenuated interferences and maintenance of the target signal. This output signal may be analyzed by the processor, such as analyzing pitch, frequency distribution, or another characteristic. As another example, a memory is provided for recording the audio signal output by the summer 18.

The beamformer channels 10 each includes a microphone 12, an analysis filter 14, a communication path 15, and a synthesis filter 16. Additional, different, or fewer components may be provided. For example, the analysis filter 14 and synthesis filter 16 are combined into one filterbank. As another example, a pre-amplifier and analog-to-digital converter are provided between the microphone 12 and the analysis filter 14. In yet another example, the communications path 15 is not provided, such as where the analysis filter 12 and synthesis filter 16 are located in a same housing or room.

The microphone 12 is a transducer for converting acoustic energy into electrical energy. Piezoelectric, drum, membrane, or other microphones may be used. In other embodiments, other sensors than acoustic sensors are used.

The analysis filter 14 is a finite impulse response filter, but infinite impulse response or other filters may be used. The analysis filter 14 has a fixed frequency response, such as a low pass, high pass, or bandpass frequency response. Discrete hardware or a programmable filter is used to implement the analysis filter 14. In one embodiment, the analysis filter 14 represents the frequency response of any electronics (e.g., pre-amp, analog-to-digital converter, down sampler, and any filters (e.g., filtering after conversion and/or down sampling)) between the microphone 12 and the communications path 15. The design of the microphone 12 and the electronics are used to determine the frequency response of the analysis filter 12, and/or the frequency response is measured.

In one embodiment, the analysis filter 14 includes a decimator for down sampling the output provided to the communications path 15. The data rate from the sampled audio signal of the microphone 12 is reduced for communication to the synthesis filter 16. An up sampler is provided in the synthesis filter 16 to up sample to the original data rate or another data rate. In alternative embodiments, down sampling and/or corresponding up sampling is not used or are provided separately from the filters.

The communications path 15 is a communications network, such as an Ethernet network. TCP/IP network communications are used. The communication network connects the output of the analysis filter 14 to the input of the synthesis filter 16. Alternatively, the communications path 15 is a wired or wireless direct connection between the analysis filter 14 and the synthesis filter 16. Any format for communications may be used.

The synthesis filter 16 is a programmable filter. The weights for one or more taps are programmable to provide different frequency response. A finite impulse or infinite impulse response filter is used. In one embodiment, the synthesis filter 16 is implemented by a processor configured for filtering, such as a general processor of a computer or server, a digital signal processor, or field programmable gate array. In other embodiments, the synthesis filter 16 is implemented as filter hardware, such as an application specific integrated circuit. The synthesis filters 16 of the different channels 10 are implemented by the same or different devices.

The synthesis filter 16 is spaced from the analysis filter 14 by the communications path 15. For example, the synthesis filter 16 is part of a control processor or computer for a building and/or the audio system while the analysis filter 14 is positioned with the microphone 12 in or by the region to be monitored.

The synthesis filters 16 each have an individually programmable frequency response. By using different and/or the same frequency response for different channels 10, the summation of the signals from the different channels may attenuation interference and maintain target sound. The analysis filter 14 may be the same for each channel 10, such as where each channel 10 uses the same electronics before the communications path 15, but may be different. The synthesis filter 16 filters the output of the analysis filter 14 after any down sampling, communication transmission, and up sampling. The frequency response used for the synthesis filter 16 of each channel 10 is determined by simultaneous solution with the location of the microphone 12 and the filter response.

The summer 18 is implemented by the same processor or component as the synthesis filter 16. Alternatively, a separate summer is used, such as a node connecting the outputs of the synthesis filters 16 or a summing device. The summer 18 combines the filtered outputs from the synthesis filters 16. The combination provides an audio signal sampled digitally with attenuated interference and maintained source acoustics. The combination of the location of the microphones 12 and the programmable filter response of the synthesis filters 16 acts to reduce sound from some locations and maintain sound from a desired location within the monitored region. The optimization finds not only the microphone locations but also the corresponding beamforming weights in the form of frequency response or filter tap values. In other words, the optimization places the microphones among a sub-set of the possible locations and offers filter responses to process the sampled output of each the placed microphones.

This processing scheme operates as a delay-scale-sum beamformer. A chosen delay and amplitude scaling are applied to each of the N microphones, and the resulting N processed signals are summed to give a final output. In the frequency domain, this delay and scaling beamforming weight is represented as simply a scaled complex exponential. Each of the N microphones sample the continuous time signal at the appropriate sampling rate (>=Nyquist). A Discrete Fourier Transform (DFT) of sufficient length to achieve the needed frequency resolution is then taken on each of the N streams of discrete samples. If the original source signals consisted only of a pure tone (i.e., single frequency) and the correct sampling rate and DFT length were chosen, the DFT transform produces an output of DFT coefficients with only one non-zero entry. For each of the N sets of DFT coefficients, the system multiplies the computed beamforming weight at the non-zero frequency bin. The beamforming weights may vary for each of the N processing streams. A set of weights that can be used to further process the DFT of the input signals are generated. The channel 10 is implemented in the time domain, so the inverse DFT (IDFT) of the DFT coefficients provides the values of the taps of the synthesis filters 16.

As used herein, the Discrete Time Fourier Transform (DTFT) of a discrete function x[t], X(w), is defined as:

$$\mathbb{X}(w) = \sum_t x[t]e^{-jwt} \tag{9}$$

If $z=e^{jw}$ in the z-transform, the DTFT is:

$$X(e^{jw}) = \sum_t x[t](e^{jw})^{-t} = \mathbb{X}(w) \tag{10}$$

In the case where the acoustic signals are broadband (e.g., the signals are assumed to be a sum of F narrowband signals), the optimization finds the optimal placement of microphones and also computes beamforming weights for each of the F frequencies of interest. If the original source signals are only of a sum of F pure tones and the correct sampling rate and DFT length are chosen, the DFT transform produces an output of DFT coefficients with only F non-zero entries. The optimization computes beamforming weights for each of the F non-zero entries for each of the N processing streams (i.e., channels 10).

Figure 3:
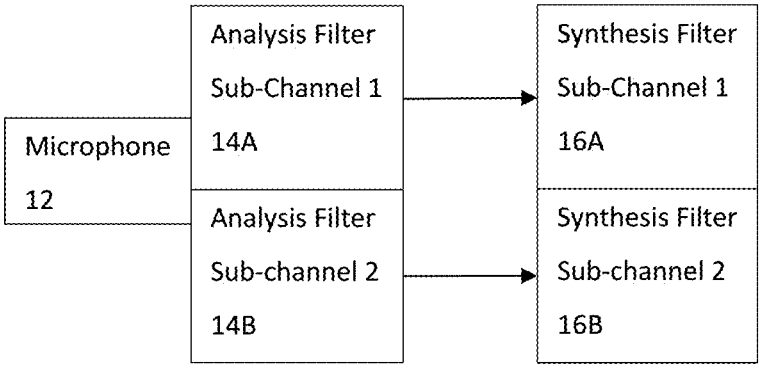
FIG. 3 illustrates one embodiment of use of sub-channels in a beamformer channel.

As represented in FIG. 3, the single frequency and broadband cases may be generalized using sub-channels. The analysis and/or synthesis filters 14, 16 are filterbanks with different frequency response for different sub-channels 14A, 14B, 16A, 16B. In this example, two sub-channels (e.g., high and low frequency) are used, but more than two sub-channels may be used. The frequency ranges for each sub-channel overlap, are adjacent, and/or are separated by a range of frequencies. The sub-channels 14A, 14B, 16A, 16B represent separate frequency response for the different ranges using the same electronics and/or represent separate filtering with separate data paths for the same signals from the same microphone 12. The output of the sub-channels 14A, 14B of the analysis filter 14 are communicated by the communications network 15 to the filterbank or sub-channels 16A, 16B of the synthesis filter 16. The synthesis filters 16 provide separately programmed filters in the filterbank with the same or different frequency response by sub-channel.

The microphone placement and filter response processing is generalized, providing N multirate filterbanks, each processing the corresponding output of one of the N microphones. Each of the N filterbanks decomposes the discrete input into C sub-channels, resulting in a total of N·C sub-channels. The output of between N and N·C microphones 12 is used without violating bandwidth constraints by selecting sub-channels to process in each filterbank. The placement of the microphones is refined to be placement by sub-channel. By using N microphones and each of the N microphones C sub-channels, the bandwidth constraint of N·C sub-channels is fulfilled. If using N·C microphones but only choosing to use one sub-channel of each of the microphones, the bandwidth constraint of N·C·1 sub-channels is fulfilled. In other words, instead of choosing the placement of N microphones out of a set of P possible microphone locations, a subset of N·C sub-channels to use out of a possible P·C sub-channels is chosen. For deploying relatively inexpensive microphones with bandwidth expense in the transfer of the collected data of each of the microphones, this selection may reduce the bandwidth cost.

In multirate filterbanks, each sub-channel is processed by both an analysis and a synthesis filter 14, 16. The analysis filters 14 are fixed to reduce the computational complexity, and, instead, the tap values for the synthesis filters 16 for each of the chosen N·C sub-channels are computed in the solution. Computing the filters for the multirate filterbanks generalizes computing beamforming weights. The DFT and IDFT implementation may be interpreted as the analysis and synthesis filtering respectively. The choice of beamforming weights corresponds to the choice of the synthesis filters.

In the embodiment represented in FIGS. 1-3, signals from each microphone 12 are processed by a two channel filterbank, with each channel being decimated and then later up sampled by a factor of 2. With 32 microphones and 2 sub-channels per microphone, there are 64 sub-channels, each of which is at one of 32 possible microphone locations. Other numbers of sub-channels in total may be provided. The two analysis filters 14A, 14B of each of the filterbanks are fixed to be Haar filters, but other filters may be used. The frequency response of the synthesis filters 16 that will minimize the maximum gain of the interferences and hence let $p=\infty$ are desired. P is the p-norm, so that $p=\infty$ is the maximum norm. The target signal is to be perfectly reconstructed, and only a certain number (e.g., 20) out of the possible 64 sub-channels are to be selected (e.g., placed). In other words, only 20 out of the 64 possible synthesis filters 16A, 16B are allowed to be active and have non-zero frequency responses. A cyclostationary process is implemented when analyzing such filterbank's statistical properties.

Figure 4:
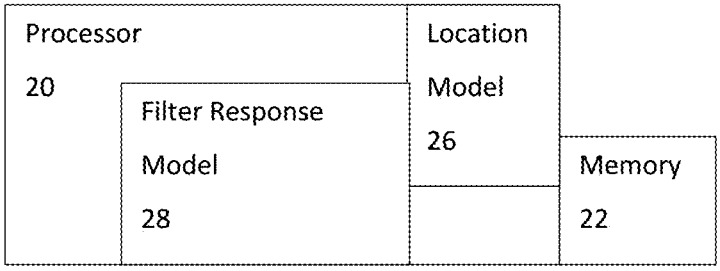
FIG. 4 is a block diagram of one embodiment of a system for determining microphone placement and filter responses.

FIG. 4 shows one embodiment of a system for placing microphones and designing filters. The system is used to optimize the placement of sub-channels in a location model 26 and the design of filter responses of a filter response model 28 for the synthesis filters. The microphone selection or placement is for design of or use of an existing array, and the filter responses to use for the selected sub-channels are simultaneously optimized by the processor 20.

The processor 20 is a general processor, server, computer, digital signal processor, field programmable gate array, application specific integrated circuit, analog circuit, digital circuit, combinations thereof, or other now known or later developed device for solving an object function (see equation (1)). The processor 20 is configured by hardware, firmware, and/or software to solve the objective function.

In one embodiment, the processor 20 is configured to determine possible locations for the microphones of an array of the microphone network in a region. The possible locations correspond to locations of existing microphones. The optimization provides a selection of a sub-set of the existing microphones. Alternatively or additionally, the possible locations correspond to locations where microphones may be installed, such as along a uniform grid in the region to be monitored. The optimization provides a selection of a sub-set of the possible locations for installation of the microphones.

The processor 20 is configured to assign two or more sub-channels for each of the possible locations and a filter for each of the sub-channels. In the modeling for solving the objective function, the possible locations designate not just the physical microphone location, but also the origin of the particular sub-channel. Each possible location has two or more sub-channels for selection or placement, so the optimization may result in one, some, all, or none of the sub-channels for a particular possible location.

The processor 20 is configured to solve an objective function that simultaneously provides for the selection or placement of sub-channels and for the filter response to be used for the synthesis filter for each selected or placed sub-channel. The solution is for a given target source, such as given target source location in the region to be monitored. Given the assigned sub-channels and corresponding filters for all the possible locations, the processor 20 uses the filter response model 28 and location model 26 represented as terms in the objective function (e.g., see equation 1) to provide an audio system for the given target source (e.g., see FIG. 1). A sub-set of available sub-channels and the filter responses for the sub-set of sub-channels are output.

The processor 20 may implement the synthesis filters, so may be configured to apply the optimized filter responses for different channels. The summer may also be implemented by the processor 20. In other embodiments, different devices implement, and the processor 20 is used for optimization.

The memory 22 is a database, cache, random access, hard drive, optical, removable, or other memory. The memory 22 is configured by the processor 20 or other processor to store the filter responses for the sub-set of sub-channels and the locations of the sub-set of sub-channels provided by the optimization. Alternatively, the processor 20 transmits the selection or placement and configures the synthesis filters with the filter responses without storage in the memory 22. The memory 22 may store other information, such as information input to and/or created during the optimization.

Alternatively or additionally, the memory 22 is a computer-readable storage device for storing instructions. The instructions, when implemented by the processor 20, cause the processor 20 to solve the objective function. The instructions for implementing the processes, methods, and/or techniques discussed herein are provided on non-transitory computer-readable storage media or memories, such as a cache, buffer, RAM, removable media, hard drive or other computer readable storage media. Computer readable storage media include various types of volatile and nonvolatile storage media. The functions, acts or tasks illustrated in the figures or described herein are executed in response to one or more sets of instructions stored in or on computer readable storage media. The functions, acts or tasks are independent of the particular type of instructions set, storage media, processor or processing strategy and may be performed by software, hardware, integrated circuits, firmware, micro code and the like, operating alone or in combination. Likewise, processing strategies may include multiprocessing, multitasking, parallel processing and the like.

Figure 5:
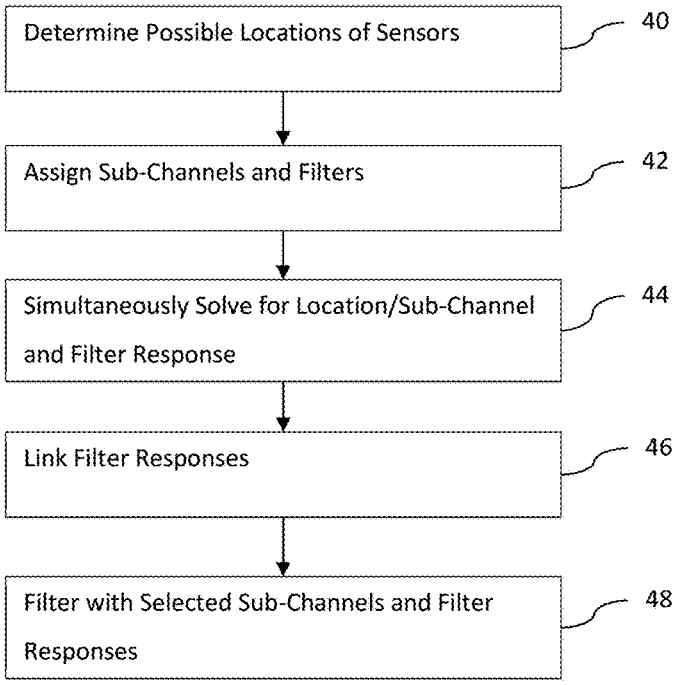
FIG. 5 is a flow chart diagram of one embodiment of a method for determining microphone placement and filter responses.

FIG. 5 shows one embodiment of a method to place microphones and design filters in a microphone network. The placement of the microphones is in the sense of selecting a sub-set of available sub-channels, the selected sub-channels indicating the location of the microphones. The method is used for initially designing the microphone network or for using an existing microphone network. The method simultaneously solves for the filter responses to be used for filtering signals from the selected sub-channels.

The optimization part of the method is performed by the system of FIG. 4, but other systems may be used. The performance part (e.g., act 48) of the method is performed by the audio system of FIGS. 2 and 3, but other audio systems and corresponding microphone networks may be used. FIG. 1 provides one example of a region for which the placement and response are simultaneously optimized, but other regions with corresponding possible locations for sub-channels may be provided.

The optimization and performance solution may operate for one or both of single and multi-frequency sources. Regardless of the type of interference and/or type of target, the optimizing of both microphone weights and positions simultaneously maintains the target acoustics while attenuating the interference acoustics, at least for a given target source location. Other audio systems may be optimized and performed for other target source locations.

Additional, different, or fewer acts may be provided. For example, acts 46 and 48 are not provided, such as where the method is for optimization without performance using the solution. As another example, acts for communicating and/or controlling are provided. In yet another example, acts 40 and 42 are combined, such as where the sub-channels and filters are provided with the microphones in an image model of placement of the possible locations.

The acts are performed in the order shown (e.g., top to bottom) or other order. For example, act 42 is performed prior to act 40. In another example, acts 40-48 or acts 44-46 are repeated for a same microphone array in a same region, but a different target source location.

In act 40, the possible locations for microphones are determined. An array of a microphone network is to be provided or already exists in a region. The possible locations are actual locations of microphones where only a sub-set are to be used for any given target source location or are locations where microphones may be later placed where only a sub-set of the possible locations are selected for later placing actual microphones. For example, the possible locations correspond to locations that may be included in a design or to locations for an already designed array. The possible locations may be uniformly spaced, but non-uniform spacing may be used. The possible locations are distributed in one, two, or three dimensions.

In act 42, two or more sub-channels are assigned for each of the possible locations. A filter is also assigned for each of the sub-channels. Using the modeling, the processor provides for sub-channels and corresponding synthesis filters for each possible location for microphones. In alternative embodiments, only one sub-channel and corresponding filter sequence (i.e., one channel without frequency division) is provided for each microphone.

Each sub-channel and corresponding filter is for a range of frequencies. The spectrum is divided into two or more ranges, such as low and high frequency sub-channels. Each sub-channel filters for signal content in the assigned frequency range. For each microphone or possible location, the same frequency divisions are used, but different divisions may be used for different possible locations.

Each sub-channel filter may be assigned as a combination of an analysis filter and synthesis filter, such as a fixed analysis filter and a programmable synthesis filter for each sub-channel. For example, an FIR filter with a plurality of taps in a multirate filterbank is assigned to each sub-channel. By linking the filters and the microphone placement, this assignment in the modeling may be used to solve for both placement and filter response simultaneously.

Figure 6:
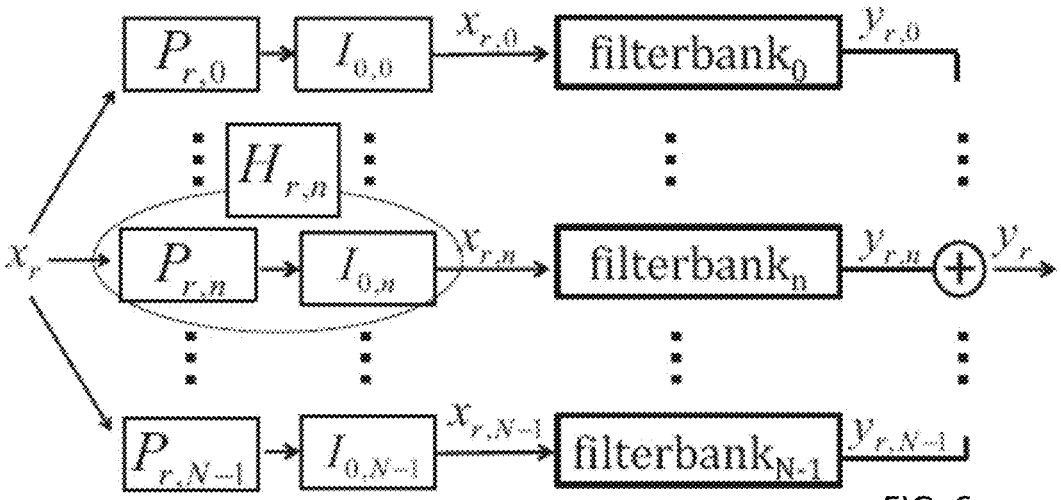
FIG. 6 illustrates one embodiment of a model used to determine microphone placement and filter responses.
Figure 7:
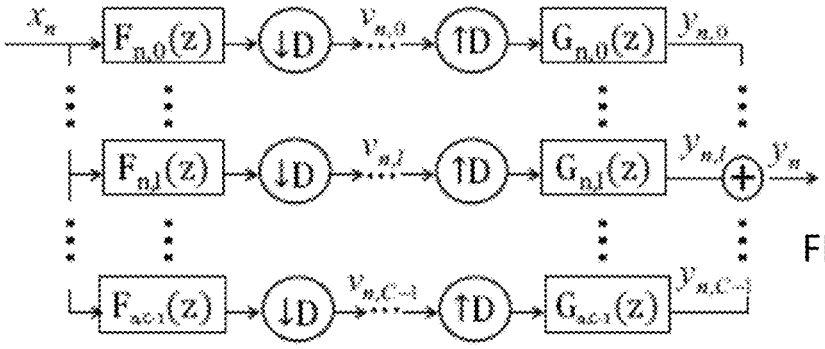
FIG. 7 illustrates one embodiment of a multirate filterbank in the model of FIG. 6.

For N microphones, the output of each of the N microphones, after pre-filtering, is processed by an individual filterbank. Each filterbank is implemented as a multi-rate, finite-impulse response (FIR) filterbank, as shown in FIG. 6. Each filterbank includes an analysis filter, down sampling and up sampling of rate, and synthesis filter as shown in FIG. 7. FIG. 7 shows three sub-channels, C. Each filterbank has a same arrangement in one example. The analysis and/or synthesis filters for each sub-channel of each filterbank may be allowed to vary. Referring to FIG. 6, each of the N filterbanks receives a signal propagating from source $x_r$. The sound from this acoustic source $x_r$ propagates to the N microphones, and the output of each the N microphones is processed by an individual multi-rate, finite-impulse response (FIR) filterbank.

The subscript r of $x_r$ indexes the l+1 sources, which include l interference sources. It is the overall gain of the interference sources that is to be minimized. The "+1" is for the target source, whose gain is to be exactly 1 or as close to 1 as possible so that the audio system perfectly or closely reconstructs the sound from the target. In the index r, the target source is treated as r=0, so the target source is denoted by $X_0$. The target source is modeled with a recorded or expected signal or is modeled with a broadband (e.g., white noise), narrowband, or single frequency signal.

Referring to FIG. 6, the propagation from source $x_r$ to the microphone n is modeled with transfer function $P_{r,n}$. The pre-filter, $I_{0,n}$, inverts the propagation from the target source, $x_0$, to filterbank n. Each filterbank is pre-filtered with a target inversion filter $I_{0,n}$ that inverts the propagation effect on the target's phase from the target $x_0$ to filterbank n. The cascade of the propagation filter $P_{r,n}$ and target inversion filter $I_{0,n}$ is denoted as $H_{r,n}$. The output of the N filterbanks are summed to give a processed signal $y_r$.

The n-th filterbank receives a sampled input originating from acoustic source $x_r$. Each microphone samples at the same uniform rate, and this rate is sufficient to recover all l+1 sources, each of which is assumed to be bandlimited. The sampled input is given by $x_{r,n}[k]=x_{r,n}(kT_s)$, where k is an integer time index and $T_s$ is the sampling period. Referring to FIG. 7, the input signal for filterbank n, $x_{r,n}$, is then fed into C sub-channels. The l-th sub-channel for the n-th filterbank is a FIR analysis filter $F_{n,l}(z)$, a down-sampler of integer D, an up-sampler (e.g., zero interpolator) of integer D, and FIR synthesis filter $G_{n,l}(z)$. The outputs of the C sub-channels are combined to give the output signal $y_{r,n}$. This modeling is performed in the frequency or in the z-domain, giving:

$$Y_{r,n}(z) = \sum_{d=0}^{D-1}\left(\frac{1}{D}\sum_{l=0}^{C-1} G_{n,l}(z)F_{n,l}(zW_D^d)\right)X_{r,n}(zW_D^d) \tag{11}$$

where $G_{n,l}$ is the transfer function of the synthesis filter of filterbank n's sub-channel l, and $F_{n,l}$ is the transfer function of the analysis filter of filterbank n's sub-channel l. In short, $y_{r,n}$ is the processed output of filterbank n given an input signal propagating from source $x_r$.

The monitored region is modeled as l+1 acoustic point sources. Given $H_{r,n}$, results in:

$$X_{r,n}(z)=H_{r,n}(z)X_r(z) \tag{12}$$

Note that the target inversion pre-filter does not vary with source $x_r$ but only varies with filterbank n. Ideally, target source $x_0$ enters each of the N filterbanks with only an amplitude scaling and with its original phase. Assuming that the propagation $P_{0,n}$ from target source $x_0$ to microphone n is inverted perfectly by prefilter $I_{0,n}$, then the cascade is represented as:

$$H_{0,n}(z) = P_{0,n}(z)I_{0,n}(z) = \alpha_{0,n}z^{-\Delta H_n}, \tag{13}$$

where $\alpha_{0,n}$ is a real scalar representing the amplitude change from propagation and $\Delta H_n$ represents a processing delay.

Referring again to FIG. 5, the sub-channels and filters assigned to the determined possible locations are used to simultaneously solve for the microphone locations and/or sub-channel locations and filter responses in act 44. A processor solves for a sub-set of the possible locations and filter responses for the filters of the sub-channels of the sub-set. The solving includes terms for both the filter response and the selection of the sub-channels for the possible locations, allowing the solution to be simultaneous. Solving for the placement of the microphones or sub-channels as a sub-set of the possible locations of the sub-channels also solves for the filter responses to use for the sub-channels of the sub-set.

The solution is optimized for a given target source location. For other target source locations, a different solution may result. A bank of audio systems or separate solutions may be used to scan the region to determine if an expected target is at various target locations. Alternatively, a single audio system is used to monitor for a target at the given target location.

The solution in one model provides coefficients in the frequency or z-transform domain. By converting back to the temporal domain, the values for taps of a FIR synthesis filter may be determined. Alternatively, the model is performed in the time domain, solving for the values of the taps. In yet other embodiments, the filtering is applied in the frequency or z-transform domain, so the filter response in that frequency or z-transform domain is used.

The solution is handled as a convex optimization. An objective function is solved. The objective function includes two or more terms. For example, one term is a p-norm of a gain of l interferences from interference sources, and another term is a penalty for the sub-channels. Both terms include consideration of the synthesis or other programmable filter responses, G, and the penalty term selects placement from a sub-set of possible locations for the microphones and corresponding sub-channel origins.

In one embodiment, the objective function includes the p-norm of the gain of the l interferences represented as $J_{I,p}$, and the other term penalizing active sub-channels represented as $J_S$. Active sub-channels are those sub-channels with non-zero synthesis filter responses. Typical p-norms of interest are p=1, 2, ∞. The severity of the active sub-channel penalty is adjusted by changing a non-negative constant, λ, to weight the active sub-channel term, $J_S$. The larger λ chosen, the more severe the active sub-channel penalty and the fewer number of active sub-channels recovered in the optimization. Conversely, the smaller λ chosen, the less severe the active sub-channel penalty and the greater number active sub-channels recovered by the optimization. By choosing λ equal to 0, the active sub-channel penalty term is eliminated altogether, allowing the use of all N·C sub-channels (i.e., selection of all of the possible locations and sub-channels for each location).

The optimization is over N·C synthesis filter responses where N is the number of microphones and C is the number of sub-channels for each microphone. The set of synthesis filter responses are denoted as G in equations (1, 4, and 8). One example expression of the objective function is:

$$J(G)=J_{I,p}(G)+\lambda\cdot J_S(G) \tag{14}$$

G is a function of continuous variable of frequency, w. To make J(G) computationally tractable, G is discretized, represented as $G_{compute}$, defined in equation (8). Both $J_{I,p}$ and $J_S$ are updated using the discretized representation, providing the objective function J(G) approximation as $J_{compute}$ ($G_{compute}$), that is:

$$\begin{aligned} J(G) &\approx J_{compute}(G_{compute}) \\ &= J_{I,p,compute}(G_{compute}) + \lambda\cdot J_{S,compute}(G_{compute}) \end{aligned} \tag{15}$$

Other objective functions with different or additional terms may be used.

In the solution, one term being optimized is $J_{I,p}(G)$, which is provided for minimizing the interference sources. The interference sources may be modeled after expected interference. In other embodiments, the interference is modeled as white noise.

The p-norm of the interference gains is the p-norm of the interference sources' time-averaged energies, that is:

$$J_{I,p}(G)=\|(\sigma_{yr}^2)_r\|_p \tag{16}$$

where the time-averaged energy $\sigma^2_{yr}$ is given below. Given that H and F are fixed and known from measurement or design for all n, the time-averaged energy only varies with synthesis filter responses G for each n.

For the case p=∞, $J_{I,p}(G)$ then becomes:

$$J_{I,\infty}(G) = \max_r \sigma^2_{yr} \tag{17}$$

The value $\sigma^2_{yr}$ is discretized for calculation in the optimization. The discretization is over the frequency, w, as a set of finite, uniformly spaced points (e.g., 16 frequencies) to give a $\sigma^2_{yrcompute}$, a computationally tractable term. Assume that all the sources have equal variance, $\sigma^2_x$, to further simplify computations of $\sigma^2_{yr}$.

One expression of $\sigma^2_{yr}$ is provided as:

$$\begin{aligned} \sigma^2_{yr} &= \frac{\sigma^2_x}{2\pi D^2}\sum_{d_1=0}^{D-1}\sum_{d_2=0}^{D-1}\int_{-\frac{\pi}{D}}^{\frac{\pi}{D}}\left|\left(\sum_{n=0}^{N-1} Q_{n,D\times D}(e^{jw})\right)_{d_1,d_2}\right|^2 dw \\ &= \frac{\sigma^2_x}{2\pi D^2}\sum_{d_1=0}^{D-1}\sum_{d_2=0}^{D-1}\int_{-\frac{\pi}{D}}^{\frac{\pi}{D}}\left|\sum_{n=0}^{N-1}(Q_{n,D\times D}(e^{jw}))_{d_1,d_2}\right|^2 dw \end{aligned} \tag{18}$$

Where D is a period. By observing that $H_{n,D\times D}(e^{jw})$ is a diagonal matrix in $Q_{n,D\times D}(e^{jw})$, a scalar expression of $Q_{n,D\times D}(e^{jw})_{d1,d2}$ results:

$$(Q_{n,D\times D}(e^{jw}))_{d_1,d_2} = \sum_{l=0}^{C-1} G_{n,l}\left(e^{j(w-w_{D,d_1})}\right)F_{n,l}\left(e^{j(w-w_{D,d_2})}\right)H_{r,n}\left(e^{j(w-w_{D,d_2})}\right) \tag{19}$$

Where $d_1$ and $d_2$ are row and column indexes of the matrix. Substituting equation 19 into equation (18) yields $$\sigma^2_{yr} = \frac{\sigma^2_x}{2\pi D^2}\sum_{d_1=0}^{D-1}\sum_{d_2=0}^{D-1}\cdot\int_{-\frac{\pi}{D}}^{\frac{\pi}{D}}\left|\sum_{n=0}^{N-1}\sum_{l=0}^{C-1} G_{n,l}\left(e^{j(w-w_{D,d_1})}\right)F_{n,l}\left(e^{j(w-w_{D,d_2})}\right)H_{r,n}\left(e^{j(w-w_{D,d_2})}\right)\right|^2 dw \tag{20}$$

The integral in equation (20) is approximated as follows:

$$\begin{aligned} &\int_{-\frac{\pi}{D}}^{\frac{\pi}{D}}\left|\sum_{n=0}^{N-1}\sum_{l=0}^{C-1} G_{n,l}\left(e^{j(w-w_{D,d_1})}\right)F_{n,l}\left(e^{j(w-w_{D,d_2})}\right)H_{r,n}\left(e^{j(w-w_{D,d_2})}\right)\right|^2 dw = \\ &\int_{-\frac{\pi}{D}}^{\frac{\pi}{D}}\left|\sum_{n=0}^{N-1}\sum_{l=0}^{C-1} G_{n,l}\left(e^{j\left(w-\frac{2\pi d_1}{D}\right)}\right)F_{n,l}\left(e^{j\left(w-\frac{2\pi d_2}{D}\right)}\right)H_{r,n}\left(e^{j\left(w-\frac{2\pi d_2}{D}\right)}\right)\right|^2 dw \approx \\ &\frac{2\pi}{N_f}\sum_{f=-\frac{N_F}{2D}}^{\frac{N_F}{2D}-1}\left|\sum_{n=0}^{N-1}\sum_{l=0}^{C-1} G_{n,l}\left(e^{j2\pi\left(\frac{f}{N_f}-\frac{d_1}{D}\right)}\right)F_{n,l}\left(e^{j2\pi\left(\frac{f}{N_f}-\frac{d_2}{D}\right)}\right)H_{r,n}\left(e^{j2\pi\left(\frac{f}{N_f}-\frac{d_2}{D}\right)}\right)\right|^2 \end{aligned} \tag{21}$$

Substituting equation (21) for the integral in equation (20) yields $\sigma^2_{yrcompute}$, an approximation of $\sigma^2_{yr}$ that is computationally tractable. This is expressed as:

$$\sigma^2_{yr} \approx \sigma^2_{yr,compute} = \frac{\sigma^2_{x_r}}{D^2 N_f}\sum_{d_1=0}^{D-1}\sum_{d_2=0}^{D-1}\cdot \sum_{f=-\frac{N_F}{2D}}^{\frac{N_F}{2D}-1}\left|\sum_{n=0}^{N-1}\sum_{l=0}^{C-1} G_{n,l}\left(e^{j2\pi\left(\frac{f}{N_f}-\frac{d_1}{D}\right)}\right)F_{n,l}\left(e^{j2\pi\left(\frac{f}{N_f}-\frac{d_2}{D}\right)}\right)H_{r,n}\left(e^{j2\pi\left(\frac{f}{N_f}-\frac{d_2}{D}\right)}\right)\right|^2 \tag{22}$$

Assume that each source $x_r$ has the same variance, that is $\sigma^2_{xr}=\sigma^2_x$ for all r, the leading coefficient may be treated as a constant, resulting in equation (22) becoming:

$$\hat{\sigma}^2_{yr,compute} = \frac{\sigma_x^2}{D^2 N_f} \cdot \sum_{d_1=0}^{D-1} \sum_{d_2=0}^{D-1} \sum_{f=-\frac{N_F}{2D}}^{\frac{N_F}{2D}-1} \left| \sum_{n=0}^{N-1} \sum_{l=0}^{C-1} G_{n,l}\left(e^{j2\pi\left(\frac{f}{N_f}-\frac{d_1}{D}\right)}\right) F_{n,l}\left(e^{j2\pi\left(\frac{f}{N_f}-\frac{d_2}{D}\right)}\right) H_{r,n}\left(e^{j2\pi\left(\frac{f}{N_f}-\frac{d_2}{D}\right)}\right) \right|^2 \tag{23}$$

To simply notation, an equality is defined as:

$$\dot{F}_{n,l,r}\left(e^{j2\pi\left(\frac{f}{N_f}-\frac{d_2}{D}\right)}\right) \equiv F_{n,l}\left(e^{j2\pi\left(\frac{f}{N_f}-\frac{d_2}{D}\right)}\right) H_{r,n}\left(e^{j2\pi\left(\frac{f}{N_f}-\frac{d_2}{D}\right)}\right) \tag{24}$$

The value of the product in equation (24) is known by assumption. The summations over n and l inside the magnitude squared are combined into a single summation over s (for sub-channel) by letting:

$$s=l+nC \text{ and } S=N\cdot C \tag{25}$$

Hence, equation (23) becomes:

$$\hat{\sigma}^2_{yr,compute} = \frac{\sigma_x^2}{D^2 N_f} \sum_{d_1=0}^{D-1} \sum_{d_2=0}^{D-1} \sum_{f=-\frac{N_F}{2D}}^{\frac{N_F}{2D}-1} \left| \sum_{s=0}^{S-1} G_s\left(e^{j2\pi\left(\frac{f}{N_f}-\frac{d_1}{D}\right)}\right) \dot{F}_{s,r}\left(e^{j2\pi\left(\frac{f}{N_f}-\frac{d_2}{D}\right)}\right) \right|^2 \tag{26}$$

(26)

To efficiently compute equation (26), the equation is rewritten as a product of a row vector, matrix, and column vector, where the row and column vector contain the unknown discretized frequency responses of all S synthesis filters. To begin, the magnitude squared of equation (26) is expanded, and the finite summations are rearranged to get:

$$\hat{\sigma}^2_{yr,compute} = \frac{\sigma_x^2}{D^2 N_f} \sum_{d_1=0}^{D-1} \sum_{f=-\frac{N_F}{2D}}^{\frac{N_F}{2D}-1} \sum_{s_1=0}^{S-1} \sum_{s_2=0}^{S-1} G_{s_1}\left(e^{j2\pi\left(\frac{f}{N_f}-\frac{d_1}{D}\right)}\right) \overline{G}_{s_2}\left(e^{j2\pi\left(\frac{f}{N_f}-\frac{d_1}{D}\right)}\right) \cdot \underbrace{\left( \sum_{d_2=0}^{D-1} F_{s_1,r}\left(e^{j2\pi\left(\frac{f}{N_f}-\frac{d_1}{D}\right)}\right) \overline{F}_{s_2,r}\left(e^{j2\pi\left(\frac{f}{N_f}-\frac{d_1}{D}\right)}\right) \right)}_{\Phi_r(s_1,s_2,f)} \tag{27}$$

using $\phi$ for F. In order to reduce the summations over both $d_1$ and f to a single summation over f, $N_f$ is assumed to be an even multiple of D, that is:

$$N_f=M\cdot D \tag{28}$$

with M a positive even integer. Rewriting the arguments to $G_{s1}$ and $\overline{G}_{s2}$, equation (27) becomes:

$$\hat{\sigma}^2_{y_r,compute} = \frac{\sigma_{x^2}}{D^2 N_f} \sum_{d_1=0}^{D-1} \sum_{f=-\frac{N_F}{2D}}^{\frac{N_F}{2D}-1} \sum_{s_1=0}^{S-1} \sum_{s_2=0}^{S-1} G_{s_1}\left(e^{j2\pi\left(\frac{f}{N_f}-\frac{d_1}{D}\right)}\right) \overline{G}_{s_2}\left(e^{j2\pi\left(\frac{f-Md_1}{N_f}\right)}\right) \Phi_r(s_1, s_2, f) \tag{29}$$

$\phi_r(s_1, s_2, f)$ is M-periodic in f, as represented as:

$$\Phi_r(s_1,s_2,f-M)=\Phi_r(s_1,s_2,f) \tag{30}$$

Equation (29) becomes:

$$\hat{\sigma}^2_{y_r,compute} = \frac{\sigma_{x^2}}{D^2 N_f} \sum_{d_1=0}^{D-1} \sum_{f=-\frac{N_F}{2D}}^{\frac{N_F}{2D}-1} \sum_{s_1=0}^{S-1} \sum_{s_2=0}^{S-1} G_{s_1}\left(e^{j2\pi\left(\frac{f-Md_1}{N_f}\right)}\right) \overline{G}_{s_2}\left(e^{j2\pi\left(\frac{f-Md_1}{N_f}\right)}\right) \Phi_r(s_1, s_2, f - Md_1) \tag{31}$$

$$f = -\frac{N_F}{2D}, \ldots, \frac{N_F}{2D} - 1 \text{ and } d_1 = 0, 1, \ldots D-1$$

in the relationship $\dot{f}=(f-Md_1)\bmod N_f$, $\dot{f}=0, 1, \ldots, N_f-1$. In addition, the z-transform is $2\pi$ periodic in w for $z=e^{jw}$, which means $f-Md_1 \bmod N_f$ may be reindexed in the arguments of $G_{s1}$ and $\overline{G}_{s2}$. Finally, since $N_f=M\cdot D$ by assumption, $\phi_r(s_1, s_2, f)$ is also $N_f$ periodic in f, which means $f-Md_1 \bmod N_f$ may be reindexed in the arguments of $\phi$. The summations over $d_1$ and f may be combined into one summation over f in equation (31) as follows:

$$\hat{\sigma}^2_{y_r,compute} = \frac{\sigma_{x^2}}{D^2 N_f} \cdot \sum_{f=0}^{N_F-1} \sum_{s_1=0}^{S-1} \sum_{s_2=0}^{S-1} G_{s_1}\left(e^{j2\pi\left(\frac{f}{N_f}\right)}\right) \overline{G}_{s_2}\left(e^{j2\pi\left(\frac{f}{N_f}\right)}\right) \Phi_r(s_1, s_2, f). \tag{32}$$

Assuming that the analysis and the synthesis filters' FIR coefficients are real, the term:

$$G_{s_1}\left(e^{j2\pi\left(\frac{f}{N_f}\right)}\right) \overline{G}_{s_2}\left(e^{j2\pi\left(\frac{f}{N_f}\right)}\right) \Phi_r(s_1, s_2, f)$$

is conjugate symmetric in continuous variable f. Hence, equation (32) is rewritten as follows:

$$\hat{\sigma}^2_{y_r,compute} = \frac{\sigma_x^2}{D^2 N_f}\left[2\sum_{f=1}^{\frac{N_f}{2}-1}\sum_{s_1=0}^{S-1}\sum_{s_2=0}^{S-1} G_{s_1}\left(e^{j2\pi\left(\frac{f}{N_f}\right)}\right)\overline{G_{s_2}}\left(e^{j2\pi\left(\frac{f}{N_f}\right)}\right)\Phi_r(s_1, s_2, f) + \sum_{s_1=0}^{S-1}\sum_{s_2=0}^{S-1} G_{s_1}\left(e^{j2\pi\left(\frac{0}{N_f}\right)}\right)\overline{G_{s_2}}\left(e^{j2\pi\left(\frac{0}{N_f}\right)}\right)\Phi_r(s_1, s_2, 0) + \sum_{s_1=0}^{S-1}\sum_{s_2=0}^{S-1} G_{s_1}\left(e^{j2\pi\left(\frac{\frac{N_f}{2}}{N_f}\right)}\right)\overline{G_{s_2}}\left(e^{j2\pi\left(\frac{\frac{N_f}{2}}{N_f}\right)}\right)\Phi_r\left(s_1, s_2, \frac{N_f}{2}\right)\right] \tag{33}$$

For a fixed f, any of the three summations over $s_1$ and $s_2$ of equation (32) may be expressed as product of a row vector, matrix, and column vector, that is:

$$\sum_{s_1=0}^{S-1}\sum_{s_2=0}^{S-1} G_{s_1}\left(e^{j2\pi\left(\frac{f}{N_f}\right)}\right)\overline{G_{s_2}}\left(e^{j2\pi\left(\frac{f}{N_f}\right)}\right)\Phi_r(s_1, s_2, f) = G_{1\times S}\left(e^{j2\pi\left(\frac{f}{N_f}\right)}\right)\Phi_{r,S\times S}(f)G^*_{1\times S}\left(e^{j2\pi\left(\frac{f}{N_f}\right)}\right) \text{ where} \tag{34}$$

$$G_{1\times S}\left(e^{j2\pi\left(\frac{f}{N_f}\right)}\right) = \left[G_{0,1\times C}\left(e^{j2\pi\left(\frac{f}{N_f}\right)}\right), G_{1,1\times C}\left(e^{j2\pi\left(\frac{f}{N_f}\right)}\right), \ldots, G_{N-1,1\times C}\left(e^{j2\pi\left(\frac{f}{N_f}\right)}\right)\right] \tag{35}$$

is a row vector, size 1×S, containing all S synthesis filters' responses at discretized frequency f. The entries of the square matrix $\phi_{r,S\times S}(f)$, size S×S, is given as:

$$(\Phi_{r,S\times S}(f))_{s_1,s_2} = \Phi_r(s_1, s_2, f) = \sum_{d_2=0}^{D-1} \dot{F}_{s_1,r}\left(e^{j2\pi\left(\frac{f}{N_f}-\frac{d_2}{D}\right)}\right)\overline{\dot{F}_{s_2,r}}\left(e^{j2\pi\left(\frac{f}{N_f}-\frac{d_2}{D}\right)}\right) \tag{36}$$

In addition, $\phi_{r,S\times S}(f)$ may be expressed as the product of the analysis matrix $$\dot{F}_{r,S\times D}\left(e^{j2\pi\left(\frac{f}{N_f}\right)}\right)$$

and its conjugate that is:

$$\Phi_{r,S\times S}(f) = \dot{F}_{r,S\times D}\left(e^{j2\pi\left(\frac{f}{N_f}\right)}\right)\dot{F}^*_{r,S\times D}\left(e^{j2\pi\left(\frac{f}{N_f}\right)}\right) \tag{37}$$

where the matrix $$\dot{F}_{r,S\times D}\left(e^{j2\pi\left(\frac{f}{N_f}\right)}\right)$$

size S by D, is defined as:

$$\dot{F}_{r,S\times D}\left(e^{j2\pi\left(\frac{f}{N_f}\right)}\right) = \begin{bmatrix} \dot{F}_{r,0,1\times C}\left(e^{j2\pi\left(\frac{f}{N_f}\right)}\right) & \dot{F}_{r,1,1\times C}\left(e^{j2\pi\left(\frac{f}{N_f}\right)}\right) & \cdots & \dot{F}_{r,N-1,1\times C}\left(e^{j2\pi\left(\frac{f}{N_f}\right)}\right) \\ \dot{F}_{r,0,1\times C}\left(e^{j2\pi\left(\frac{f}{N_f}-\frac{1}{D}\right)}\right) & \dot{F}_{r,1,1\times C}\left(e^{j2\pi\left(\frac{f}{N_f}-\frac{1}{D}\right)}\right) & \cdots & \dot{F}_{r,N-1,1\times C}\left(e^{j2\pi\left(\frac{f}{N_f}-\frac{1}{D}\right)}\right) \\ \vdots & \vdots & \ddots & \vdots \\ \dot{F}_{r,0,1\times C}\left(e^{j2\pi\left(\frac{f}{N_f}-\frac{D-1}{D}\right)}\right) & \dot{F}_{r,1,1\times C}\left(e^{j2\pi\left(\frac{f}{N_f}-\frac{D-1}{D}\right)}\right) & \cdots & \dot{F}_{r,N-1,1\times C}\left(e^{j2\pi\left(\frac{f}{N_f}-\frac{D-1}{D}\right)}\right) \end{bmatrix} \tag{38}$$

and consists of D·N column vectors, size C by 1, defined in row vector notation as:

$$\dot{F}_{r,n,1\times C}\left(e^{j2\pi\left(\frac{f}{N_f}-\frac{d}{D}\right)}\right) = H_{r,n}\left(e^{j2\pi\left(\frac{f}{N_f}-\frac{d}{D}\right)}\right).\left[F_{n,0}\left(e^{j2\pi\left(\frac{f}{N_f}-\frac{d}{D}\right)}\right), F_{n,1}\left(e^{j2\pi\left(\frac{f}{N_f}-\frac{d}{D}\right)}\right), \ldots, F_{n,C-1}\left(e^{j2\pi\left(\frac{f}{N_f}-\frac{d}{D}\right)}\right)\right] \tag{39}$$

with $d\in\{0, 1, \ldots, D-1\}$. Hence, equation (34) is rewritten as follows:

$$\sum_{s_1=0}^{S-1}\sum_{s_2=0}^{S-1} G_{s_1}\left(e^{j2\pi\left(\frac{f}{N_f}\right)}\right)\overline{G_{s_2}}\left(e^{j2\pi\left(\frac{f}{N_f}\right)}\right)\Phi_r(s_1, s_2, f) = G_{1\times S}\left(e^{j2\pi\left(\frac{f}{N_f}\right)}\right)\Phi_{r,S\times S}(f)G^*_{1\times S}\left(e^{j2\pi\left(\frac{f}{N_f}\right)}\right) = G_{1\times S}\left(e^{j2\pi\left(\frac{f}{N_f}\right)}\right)\dot{F}_{r,S\times D}\left(e^{j2\pi\left(\frac{f}{N_f}\right)}\right)\dot{F}^*_{r,S\times D}\left(e^{j2\pi\left(\frac{f}{N_f}\right)}\right)G^*_{1\times S}\left(e^{j2\pi\left(\frac{f}{N_f}\right)}\right) = \left\|\dot{F}^*_{r,S\times D}\left(e^{j2\pi\left(\frac{f}{N_f}\right)}\right)G^*_{1\times S}\left(e^{j2\pi\left(\frac{f}{N_f}\right)}\right)\right\|^2. \tag{40}$$

The right hand side of equation (33) is then expressed as a product of a block diagonal matrix and column vector, that is:

$$\hat{\sigma}^2_{yr,compute} = \frac{\sigma_{x2}}{D^2 N_f} \cdot 2\left\| \dot{F}^*_{r,S\left(\frac{N_f}{2}+1\right)\times D\left(\frac{N_f}{2}+1\right)}\left(e^{j2\pi\left(\frac{f}{N_f}\right)}\right) G^*_{1\times S\left(\frac{N_f}{2}+1\right)}\left(e^{j2\pi\left(\frac{f}{N_f}\right)}\right)\right\|^2 \tag{41}$$

and by transpose and conjugation, the following is provided:

$$\hat{\sigma}^2_{yr,compute} = \frac{\sigma^2_x}{D^2 N_f} \cdot 2\left\| G_{1\times S\left(\frac{N_f}{2}+1\right)}\left(e^{j2\pi\left(\frac{f}{N_f}\right)}\right) \dot{F}_{r,S\left(\frac{N_f}{2}+1\right)\times D\left(\frac{N_f}{2}+1\right)}\left(e^{j2\pi\left(\frac{f}{N_f}\right)}\right)\right\|^2 \tag{42}$$

where $$\dot{F}_{r,S\left(\frac{N_f}{2}+1\right)\times D\left(\frac{N_f}{2}+1\right)}\left(e^{j2\pi\left(\frac{f}{N_f}\right)}\right) = \mathrm{diag}\left(\frac{1}{\sqrt{2}}\dot{F}_{r,S\times D}(e^{j2\pi(0)}),\ \dot{F}_{r,S\times D}\left(e^{j2\pi\left(\frac{1}{N_f}\right)}\right), \ldots,\ \dot{F}_{r,S\times D}\left(e^{j2\pi\left(\frac{N_f}{2}-1\right)}\right),\ \frac{1}{\sqrt{2}}\dot{F}_{r,S\times D}\left(e^{j2\pi\left(\frac{N_f}{2}\right)}\right)\right) \tag{43}$$

and $$G_{1\times S\left(\frac{N_f}{2}+1\right)}\left(e^{j2\pi\left(\frac{f}{N_f}\right)}\right) = \left[\ G_{1\times S}(e^{j2\pi(0)})\quad G_{1\times S}\left(e^{j2\pi\left(\frac{1}{N_f}\right)}\right)\quad \ldots\quad G_{1\times S}\left(e^{j2\pi\left(\frac{N_f}{2}\right)}\right)\right]. \tag{44}$$

$J_I(G)$ may be a computationally tractable approximation. Using equation (42), the computationally tractable approximation of equation (16) is provided as:

$$\begin{aligned} J_{I,P}(G) &= \left\|(\sigma^2_{yr})_r\right\|_P \\ &\approx \left\|(\hat{\sigma}^2_{yr,compute})_r\right\|_P \\ &= J_{I,P,compute}(G_{compute}) \end{aligned} \tag{45}$$

The JS term of the objective function of equation (14) is a penalty term. The penalty term forces selection of a sparse array of sub-channels. A computationally tractable and efficient sparse sub-channel penalty term $J_{S,compute}(G_{compute})$ may be derived. The derivation begins by defining $J_{S,sgn}(G)$, which counts the number of active sub-channels by seeing whether each sub-channel's synthesis filter frequency response is non-zero or not. Alternatively, a sufficiently low (e.g., thresholded) level of frequency response may be treated as zero response. The continuous frequency variable, w, is discretized along a finite, uniformly or other spaced set of points to give the computationally tractable term $J_{S,sgn,compute}(G_{compute})$. Finally, an L−1 like penalty is substituted to not only increase computational efficiency but also to induce sparse solutions to give the desired $J_{S,compute}(G_{compute})$.

Solving the objective function not only minimizes the gain (e.g., time-averaged energy or other measure of gain) of interference sources but also encourages sparse sub-channels. Sparse sub-channels express a sub-set of the possible sub-channels given the possible sub-channels. For example, only a few of the N*C sub-channels are active. As before, N is the number of microphones, and C is the number of sub-channels of each microphone. In one embodiment, a sub-channel is inactive if its synthesis filter frequency response is zero or very small in magnitude. Any threshold may be used for "very small." The number of active sub-channels as is represented as follows:

$$J_{S,sgn}(G) = \sum_{n=0}^{N-1}\sum_{l=0}^{C-1} \mathrm{sgn}^2\left(\max_{0\le w<\pi} |G_{n,l}(e^{jw})|\right) \tag{46}$$

where $\mathrm{sgn}^2(x)$ is 1 if x<0, 0 if x=0, and 1 if x>0. In other words, a channel is considered active if any portion of its frequency response is non-zero. $0\le w<\pi$ rather than $0\le w<2\pi$ is used since the filter taps are real and hence the frequency response is conjugate symmetric. Equation (46) counts the number of active sub-channels and since sgn is applied to the maximum of absolute values, the value of equation (46) lies in the appropriate range of 0 to N·C.

To make equation (46) computationally tractable, the continuous frequency variable, w, is discretized using the $N_f$ points as is done for equation (21), so equation (46) becomes:

$$\begin{aligned} J_{S,sgn}(G) &\approx J_{S,sgn,compute}(G_{compute}) \\ &= \sum_{n=0}^{N-1}\sum_{l=0}^{C-1} \mathrm{sgn}^2\left(\max_{f\in\{0,1,\ldots,N_f/2\}}\left|G_{n,l}\left(e^{j2\pi\frac{f}{N_f}}\right)\right|\right) \end{aligned} \tag{47}$$

The summations over n and l are combined into a single summation over s using equation (25), as before. In addition, similar to the spirit of Compressive Sampling, the $\mathrm{sgn}^2$ function is replaced by the absolute value. Equation (47) becomes:

$$J_{S,abs,compute}(G_{compute}) = \sum_{s=0}^{S-1}\left(\max_{f\in\{0,1,\ldots,N_f/2\}}\left|G_s\left(e^{j2\pi\frac{f}{N_f}}\right)\right|\right). \tag{48}$$

The penalty term of the object function is a maximum of an absolute value of an infinity norm with discrete frequencies.

In the objective function of equation (15), equation (48) is used. Shortening the notation provides:

$$J_{S,compute}(G_{compute}) = J_{S,abs,compute}(G_{compute}) \tag{49}$$

Using this term with the constant λ, the optimization may be iteratively performed. Different values of the constant are tested until the desired number of sub-channels results from minimization of the objective function. The user inputs a number of sub-channels to be used in the audio system. The number is less than N*C. The optimization solves with the penalty term including a count of the sub-channels with the respective frequency responses above a threshold or active. The sub-channels with the respective frequency response above the threshold are included in the sub-set of the placement, and the sub-channels with the respective frequency response below the threshold are not included in the sub-set. Different values of the constant result in different numbers of sub-channels in the active and inactive sub-sets.

In one embodiment, the optimization problem is run iteratively to tune the parameter λ at each iteration until the desired number (e.g., 20 out of 64) of active sub-channels results. Any search pattern or approach may be used to select the next value of the constant to use in each iteration. For example, λ, a non-negative scalar, is found through a bisection algorithm since as λ increases, the number of active sub-channel decreases, and similarly as λ decreases, the number of active sub-channels increase.

Figure 9:
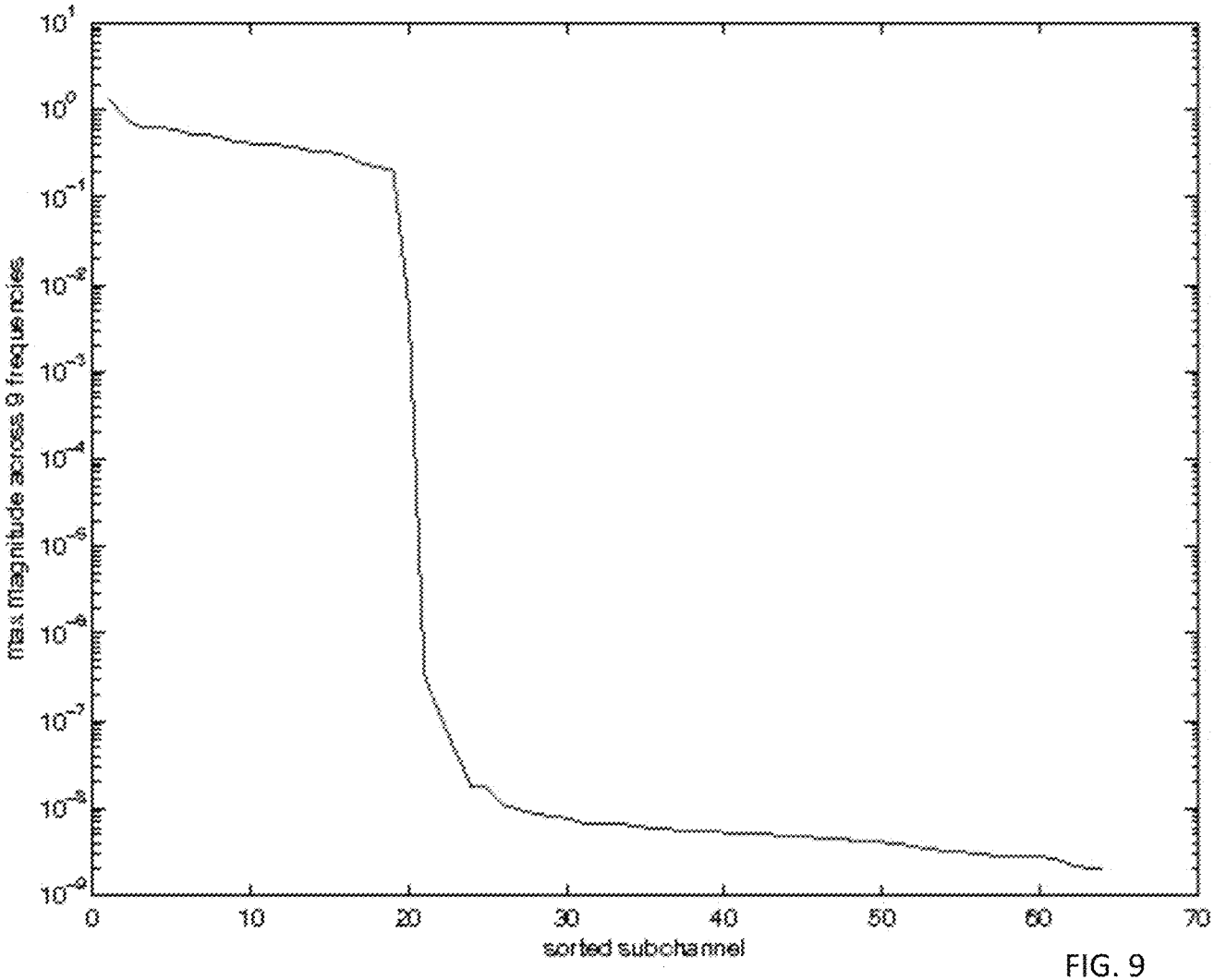
FIG. 9 is an example plot of maximum magnitudes of synthesis filter responses for sub-channels.
Figure 10:
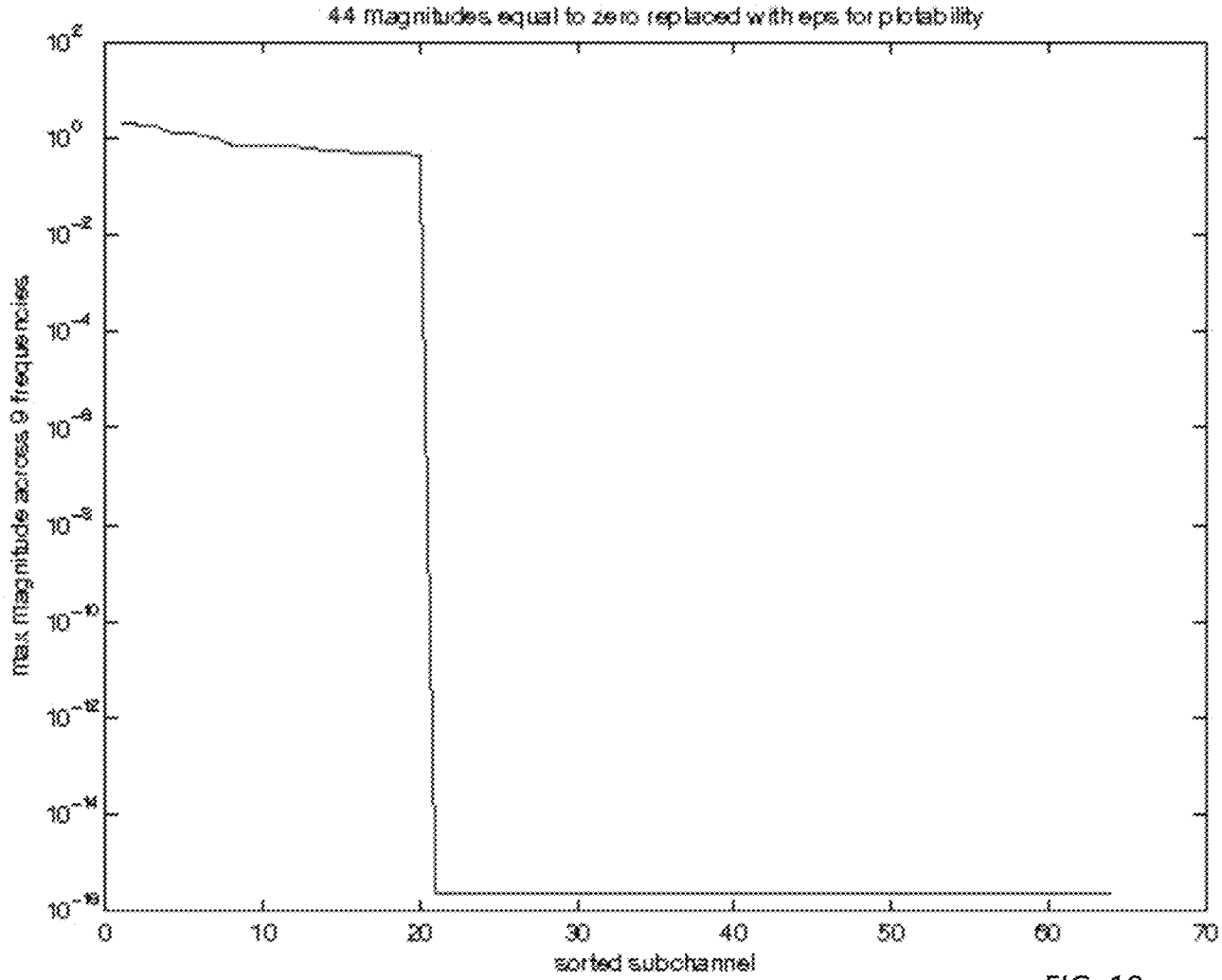
FIG. 10 is the example plot of the maximum magnitudes after deselecting some of the sub-channels.

In one embodiment, a sub-channel is considered inactive if the maximum magnitude of its synthesis filter response is less than 1/1000 of the greatest maximum magnitude of the responses of the synthesis filters. FIG. 9 shows the maximum magnitude of each sub-channel's synthesis filter after finding a value for λ resulting in 20 active sub-channels. 20 of the 64 sub-channel have non-trivial synthesis filters. The sub-channels in FIG. 9 are sorted by maximum magnitude. Each sub-channel maps to a respective microphone. A sparse number of synthesis filters and thus a sparse number of active sub-channels are found through optimization. However, the frequency responses of the inactive synthesis filters are not exactly zero. The solution may be performed again with the penalty term set to zero (e.g., λ=0). In running the optimization routine one more time, the synthesis filters of only the previously discovered active sub-channels are included. This debiasing step, in some sense, redistributes the "crumbs" of energy in the inactive sub-channels' synthesis filters to the active sub-channels' synthesis filters. FIG. 10 shows each sub-channel's maximum synthesis filter magnitude after this debiasing step. In alternative embodiments, the debiasing is not performed, and the inactive sub-channels are not used.

The objective function with the multiple terms is subject to a constraint of target source perfect reconstruction during the minimization. Other than perfect reconstruction may be used in alternative embodiments. The target perfect reconstruction condition, TPR, discretizes the continuous variable, w, using $N_f$ points. For f=0, 1, . . . ,Nf−1, the TPR is given as:

$$TPR_{compute}(f,d)=\sum_{n=0}^{N-1}H_{0,n}\left(e^{j2\pi\left(\frac{f}{N_f}-\frac{d}{D}\right)}\right)\sum_{l=0}^{C-1}G_{n,l}\left(e^{j2\pi\left(\frac{f}{N_f}\right)}\right)F_{n,l}\left(e^{j2\pi\left(\frac{f}{N_f}-\frac{d}{D}\right)}\right)=\begin{cases}De^{j2\pi\left(\frac{f}{N_f}\right)(-\Delta)} & \text{if } d=0;\\ 0 & \text{if } 1\le d\le D-1\end{cases} \tag{50}$$

Since there are D constraints for each of the $N_f$ discretized frequencies, the TPR condition has a total of $N_f$−D constraints.

In matrix-vector form, the D target perfect reconstruction of conditions of equation (50) for a fixed f∈{0, 1, . . . ,$N_f$−1} are written as:

$$TPR_{compute}(f)=\dot{F}^T_{S\times D}\left(e^{j2\pi\left(\frac{f}{N_f}\right)}\right)G^T_{1\times S}\left(e^{j2\pi\left(\frac{f}{N_f}\right)}\right)=De^{j2\pi\left(\frac{f}{N_f}\right)(-\Delta)}\cdot e^T_{0,1\times D} \tag{51}$$

where S=N·C, the number of sub-channels. The matrix $\dot{F}_{S\times D}(f)$, size D by S, is defined as:

$$\dot{F}^T_{S\times D}\left(e^{j2\pi\left(\frac{f}{N_f}\right)}\right)=\begin{bmatrix}\dot{F}_{0,1\times C}\left(e^{j2\pi\left(\frac{f}{N_f}\right)}\right) & \dot{F}_{1,1\times C}\left(e^{j2\pi\left(\frac{f}{N_f}\right)}\right) & \dots & \dot{F}_{N-1,1\times C}\left(e^{j2\pi\left(\frac{f}{N_f}\right)}\right)\\ \dot{F}_{0,1\times C}\left(e^{j2\pi\left(\frac{f}{N_f}-\frac{1}{D}\right)}\right) & \dot{F}_{1,1\times C}\left(e^{j2\pi\left(\frac{f}{N_f}-\frac{1}{D}\right)}\right) & \dots & \dot{F}_{N-1,1\times C}\left(e^{j2\pi\left(\frac{f}{N_f}-\frac{1}{D}\right)}\right)\\ \vdots & \vdots & \ddots & \vdots\\ \dot{F}_{0,1\times C}\left(e^{j2\pi\left(\frac{f}{N_f}-\frac{D-1}{D}\right)}\right) & \dot{F}_{1,1\times C}\left(e^{j2\pi\left(\frac{f}{N_f}-\frac{D-1}{D}\right)}\right) & \dots & \dot{F}_{N-1,1\times C}\left(e^{j2\pi\left(\frac{f}{N_f}-\frac{D-1}{D}\right)}\right)\end{bmatrix} \tag{52}$$

and includes D·N row vectors, size 1 by C, defined as:

$$\dot{F}_{n,1\times C}\left(e^{j2\pi\left(\frac{f}{N_f}-\frac{d}{D}\right)}\right)=H_{0,n}\left(e^{j2\pi\left(\frac{f}{N_f}-\frac{d}{D}\right)}\right).\left[F_{n,0}\left(e^{j2\pi\left(\frac{f}{N_f}-\frac{d}{D}\right)}\right),F_{n,1}\left(e^{j2\pi\left(\frac{f}{N_f}-\frac{d}{D}\right)}\right),\dots,F_{n,C-1}\left(e^{j2\pi\left(\frac{f}{N_f}-\frac{d}{D}\right)}\right)\right] \tag{53}$$

with d∈{0, 1, . . . , D−1}.

The column vector $$G^T_{1\times S}\left(e^{j2\pi\left(\frac{f}{N_f}\right)}\right),$$

size S by 1, is defined as:

$$G^T_{1\times S}\left(e^{j2\pi\left(\frac{f}{N_f}\right)}\right)=\begin{bmatrix}G^T_{0,1\times C}\left(e^{j2\pi\left(\frac{f}{N_f}\right)}\right)\\ G^T_{1,1\times C}\left(e^{j2\pi\left(\frac{f}{N_f}\right)}\right)\\ \vdots\\ G^T_{N-1,1\times C}\left(e^{j2\pi\left(\frac{f}{N_f}\right)}\right)\end{bmatrix} \tag{54}$$

and includes N column vectors, size C by 1, defined as:

$$G^T_{n,1\times C}\left(e^{j2\pi\left(\frac{f}{N_f}\right)}\right)=\left[G_{n,0}\left(e^{j2\pi\left(\frac{f}{N_f}\right)}\right),G_{n,1}\left(e^{j2\pi\left(\frac{f}{N_f}\right)}\right),\dots,G_{n,C-1}\left(e^{j2\pi\left(\frac{f}{N_f}\right)}\right)\right]^T \tag{56}$$

The column vector $e^T_{k,1\times D}$, size D×1, is defined as the D×1 zero vector but with the k-th entry set to 1, that is:

$$e^T_{k,1\times D} = \left[0, \ldots 0, \underbrace{1}_{k\text{-th entry of } D \text{ size vector}}, 0, \ldots 0\right]^T \tag{57}$$

If the same set of C analysis filters are used for each filterbank that is:

$$\left[F_{n1,0}\left(e^{j2\pi\left(\frac{f}{N_f}-\frac{d}{D}\right)}\right), F_{n1,1}\left(e^{j2\pi\left(\frac{f}{N_f}-\frac{d}{D}\right)}\right), \ldots, F_{n1,C-1}\left(e^{j2\pi\left(\frac{f}{N_f}-\frac{d}{D}\right)}\right)\right] = \left[F_{n2,0}\left(e^{j2\pi\left(\frac{f}{N_f}-\frac{d}{D}\right)}\right), F_{n2,1}\left(e^{j2\pi\left(\frac{f}{N_f}-\frac{d}{D}\right)}\right), \ldots, F_{n2,C-1}\left(e^{j2\pi\left(\frac{f}{N_f}-\frac{d}{D}\right)}\right)\right] \tag{58}$$

for all $0 \le n1, n2 \le N-1$, $0 \le d \le D-1$, and $0 \le f \le N_f-1$, and the target inversion pre-filter removes the effect on phase from propagation perfectly, that is:

$$H_{0,n}\left(e^{j2\pi\left(\frac{f}{N_f}-\frac{d}{D}\right)}\right) = \alpha_{0,n} \tag{59}$$

for all $0 \le n \le N-1$, $0 \le d \le D-1$, and $0 \le f \le N_f-1$, then equation (52) is of rank=min(D,C) since every C columns are scalar multiples of the previous C columns. Since D constraints are to be fulfilled, these two additional assumptions imply that $D \le C$.

If all filter taps are real, then the number of constraints may be almost halved using the conjugate symmetry of filter responses and the $2\pi$ periodicity in w in the z-transform for $z=e^{jw}$. First, if equation (51) holds for $0 \le f \le N_f-1$, then the conjugate of the entire equation also holds, that is:

$$\overline{\dot{F}^T_{S\times D}\left(e^{j2\pi\left(\frac{f}{N_f}\right)}\right) G^T_{1\times S}\left(e^{j2\pi\left(\frac{f}{N_f}\right)}\right)} = \overline{D \cdot e^T_{0,1\times D}} = D \cdot e^T_{0,1\times D} \tag{60}$$

where the last equality follows because $e^T_{0,1\times D}$ contains all real entries. Next:

$$\begin{aligned} &\overline{\dot{F}^T_{S\times D}\left(e^{j2\pi\left(\frac{f}{N_f}\right)}\right) G^T_{1\times S}\left(e^{j2\pi\left(\frac{f}{N_f}\right)}\right)} = D \cdot e^T_{0,1\times D} \\ &\dot{F}^T_{S\times D}\left(e^{j2\pi\left(\frac{-f}{N_f}\right)}\right) G^T_{1\times S} e^{j2\pi\left(\frac{-f}{N_f}\right)}\Big) = D \cdot e^T_{0,1\times D} \\ &\dot{F}^T_{S\times D}\left(e^{j2\pi\left(\frac{-f \bmod N_f}{N_f}\right)}\right) G^T_{1\times S}\left(e^{j2\pi\left(\frac{-f \bmod N_f}{N_f}\right)}\right) = D \cdot e^T_{0,1\times D} \end{aligned} \tag{61}$$

where the second line follows from conjugate symmetry and the third line follows from $2\pi$ periodicity in w. In summary, if $TPR_{compute}(f)$ holds, so does $TPR_{compute}(-f \bmod N_f)$. Hence, the constraints of equation (51) for all f as a product of a block-diagonal matrix-vector multiply, that is:

$$\dot{F}^T_{\left(\frac{N_f}{2}+1\right)S\times\left(\frac{N_f}{2}+1\right)D} G^T_{1\times\left(\frac{N_f}{2}+1\right)S} = D \cdot \dot{E}^T_{0,1\times\left(\frac{N_f}{2}+1\right)D} \tag{62}$$

and by transposition:

$$G_{1\times\left(\frac{N_f}{2}+1\right)S} \dot{F}_{\left(\frac{N_f}{2}+1\right)S\times\left(\frac{N_f}{2}+1\right)D} = D \cdot \dot{E}_{0,1\times\left(\frac{N_f}{2}+1\right)D} \tag{63}$$

where the block diagonal matrix $$\dot{F}_{\left(\frac{N_f}{2}+1\right)S\times\left(\frac{N_f}{2}+1\right)D}$$

size $$\left(\frac{N_f}{2}+1\right)S \times \left(\frac{N_f}{2}+1\right)D$$

is given by:

$$\dot{F}_{\left(\frac{N_f}{2}+1\right)S\times\left(\frac{N_f}{2}+1\right)D} = \mathrm{diag}\left(\frac{1}{\sqrt{2}}\dot{F}_{S\times D}\left(e^{j2\pi\left(\frac{0}{N_f}\right)}\right), \dot{F}_{S\times D}\left(e^{j2\pi\left(\frac{1}{N_f}\right)}\right), \ldots, \dot{F}_{S\times D}\left(e^{j2\pi\left(\frac{\frac{N_f}{2}-1}{N_f}\right)}\right), \frac{1}{\sqrt{2}}\dot{F}_{S\times D}\left(e^{j2\pi\left(\frac{\frac{N_f}{2}}{N_f}\right)}\right)\right), \tag{64}$$

the row vector of unknowns $$G_{1\times\left(\frac{N_f}{2}+1\right)S}$$

size $$1 \times \left(\frac{N_f}{2}+1\right)S$$

is given by:

$$G_{1\times\left(\frac{N_f}{2}+1\right)S} = \left[G_{1\times S}\left(e^{j2\pi\left(\frac{0}{N_f}\right)}\right), G_{1\times S}\left(e^{j2\pi\left(\frac{1}{N_f}\right)}\right), \ldots, G_{1\times S}\left(e^{j2\pi\left(\frac{\frac{N_f}{2}}{N_f}\right)}\right)\right], \tag{65}$$

and the row vector of constraints $$E_{0,1\times\left(\frac{N_f}{2}+1\right)D}$$

size $$1\times\left(\frac{N_f}{2}+1\right)D'$$

is given by:

$$\dot{E}_{0,1\times\left(\frac{N_f}{2}+1\right)D}=\left[\underbrace{\frac{1}{\sqrt{2}}e^{j2\pi\left(\frac{0}{N_f}\right)(-\Delta)}e_{0,1\times D}}_{f=0},\ \underbrace{e^{j2\pi\left(\frac{1}{N_f}\right)(-\Delta)}e_{0,1\times D}}_{f=1},\ \ldots,\ \underbrace{e^{j2\pi\left(\frac{\frac{N_f}{2}-1}{N_F}\right)(-\Delta)}e_{0,1\times D}}_{f=\frac{N_f}{2}-1},\ \underbrace{\frac{1}{\sqrt{2}}e^{j2\pi\left(\frac{\frac{N_f}{2}}{N_F}\right)(-\Delta)}e_{0,1\times D}}_{f=\frac{N_f}{2}}\right] \tag{66}$$

As before, S represents the total number of sub-channels and is equal to the product the number of filterbanks N and the number of sub-channels per filterbank C, that is S=N·C.

In addition, by conjugating equation (62), the terms are consistent with equation (40) where the unknown synthesis filters are a column vector, resulting in:

$$TPR_{compute}=\dot{F}^{*}_{\left(\frac{N_f}{2}+1\right)S\times\left(\frac{N_f}{2}+1\right)D}G^{*}_{1\times\left(\frac{N_f}{2}+1\right)S}=D\cdot\dot{E}^{*}_{0,1\times\left(\frac{N_f}{2}+1\right)D} \tag{67}$$

The results of the above equations provide the objective function to be optimized. This objective function is computationally tractable. The optimization is represented as:

$$\underset{G_{compute}}{minimize}\ J_{compute}(G_{compute})=J_{I,p,compute}(G_{compute})+\lambda J_{S,compute}(G_{compute}) \tag{68}$$

subject to $$TPR_{compute}$$

where $G_{compute}$ is given by equation (8), $J_{I,p,compute}$ is given by equation (45), $J_{S,compute}$ is given by equation (48) via equation (49), and $TPR_{compute}$ is given by equation (63). The optimization of equation (68) is convex.

The solution of act 44 may be iteratively performed to provide a desired, predetermined, or user set number of placed sub-channels. Different values of λ are used until the optimization results in the set number of sub-channels. In alternative embodiments, a given value of λ is used and the resulting sub-set of sub-channels, regardless of the specific number, are placed or used. In yet another embodiment, different values of λ are used until the optimization results in a number of microphones being used. Each selected microphone of the sub-set may be associated with all or only some of the available sub-channels for that microphone.

Referring again to FIG. 5, the filter responses are linked to the microphones at the selected locations in act 46. The optimization provides a sub-set of possible locations for sub-channels. For any location for which at least one sub-channel is selected, a microphone is to be placed or used. The microphone connects to an analysis filter and a synthesis filter. The filters may be provided as a multirate filterbank, so all or only some of the sub-channels are used. Alternatively, filters for the number of sub-channels included in the sub-set are provided without providing filters for other sub-channels.

The linking associates the optimized filter responses for the synthesis filters with each selected sub-channel. Labeling, loading the filter taps into the synthesis filter, assignment by reference number, or other linking associates the appropriate filter response with the appropriate microphone and microphone placement. For each of the selected possible locations of the sub-set identified by solving the objective function, linked filter responses are provided.

The linking is stored. For example, the association is stored with the filter responses. When the audio system for the target source location is to be used, the linked filter responses are loaded from memory into the programmable synthesis filters. The communication network provides the analysis filtered outputs for the desired or selected sub-channels from microphones at the selected locations for filtering by the programmed synthesis filters. Alternatively, the linking is used to program the synthesis filters without storage.

Acts 44 and 46 may be repeated for different target source locations and/or target source acoustic signals. An optimization is performed for each target source location and/or signal. Each optimization may result in different sub-sets of sub-channels and corresponding microphone locations of the possible locations. The same availability of sub-channels and possible locations are used, but the difference in location of the target source results in different placement of microphones and sub-channels as well as different filter responses. The same placement of microphones and/or sub-channels may occur with different filter responses or vice versa.

The repetition results in different audio systems for different target source locations and/or target signals. Where the same microphone array is to be used for the different audio system, the microphones needed for all the audio systems are placed, either through selection of existing microphones or installing of microphones. When any given audio system is active, the sub-set of sub-channels for that audio system are active or used.

In act 48, the optimized audio system is used. The microphones and sub-channels for the audio system are activated and/or connected through the communications network. The synthesis filters are programmed with the optimized filter responses. The beamformer designed by the optimization is established or configured with the microphones and sub-channels of the sub-set of possible locations.

Once configuration is complete, the signal or data representing the audio signals sensed by the microphones are processed along the beamformer channels. The active sub-channels provide the processing. For each active sub-channel, analysis filtering and synthesis filtering are provided. The resulting sub-channel signals are summed, providing signal or data representing the target source, if any, at the target location with attenuation of any interference sources.

Figure 11A:
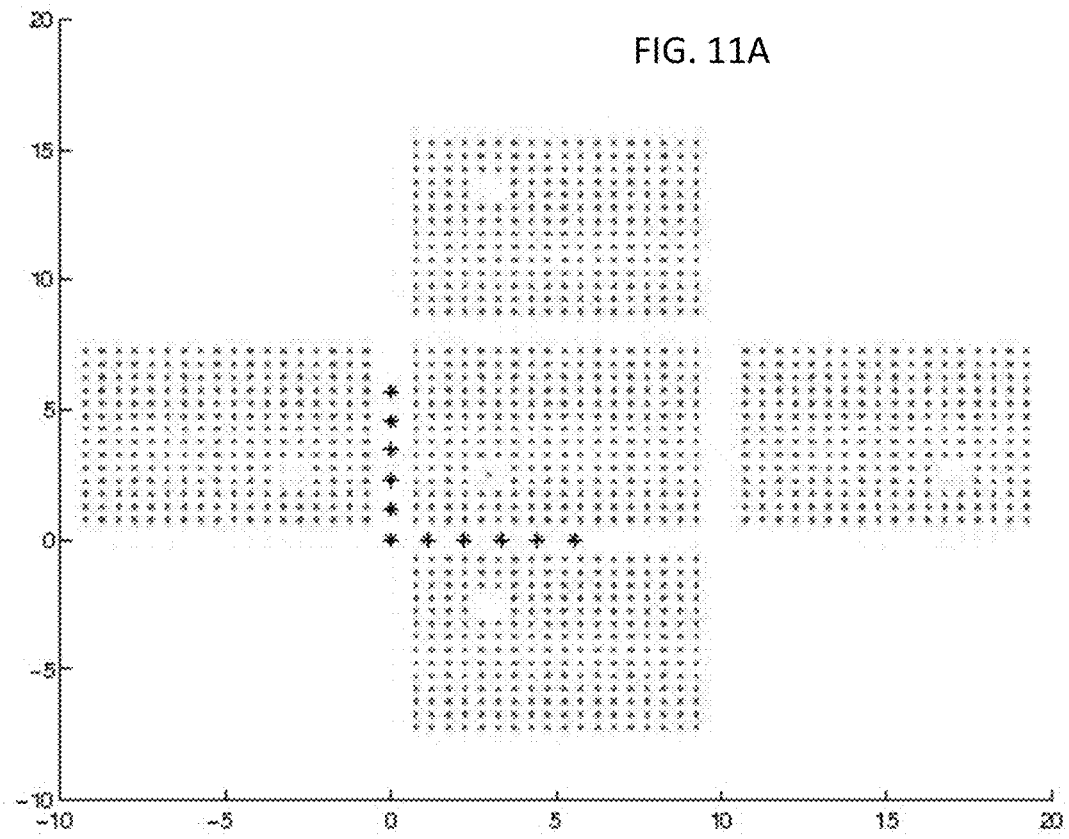
FIG. 11A is the example room of FIG. 1, but with a sub-set of low frequency sub-channels and corresponding microphones selected.
Figure 11B:
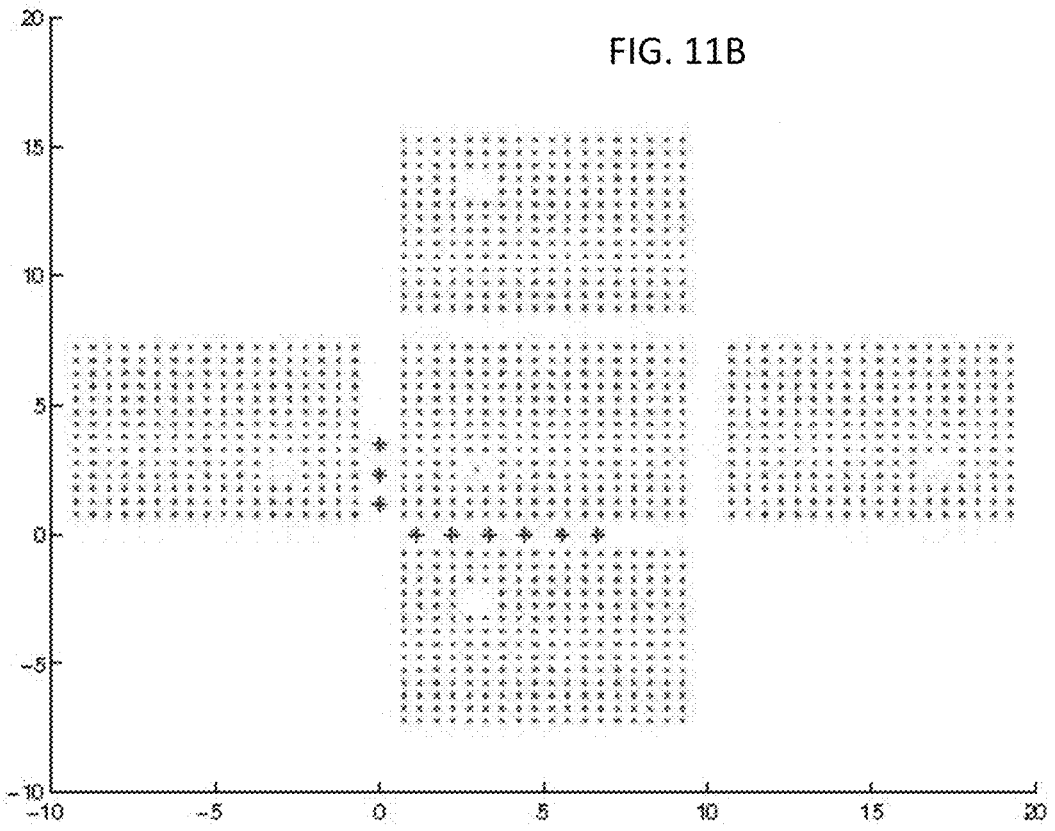
FIG. 11B is the example room of FIG. 1, but with a sub-set of high frequency sub-channels and corresponding microphones selected.

In one example using the 32 possible locations of microphones and target source location of FIG. 1 with 2 sub-channels per microphone, the optimization routine is run iteratively to return 20 sub-channels and corresponding filter responses. The optimization returns a setup that uses slightly more low-frequency sub-channels than high-frequency sub-channels. Furthermore, the setup even occasionally uses only a single sub-channel of a filterbank and not the other sub-channel. FIGS. 9 and 10 show the maximum magnitudes of the filter responses. FIG. 11A shows the sub-set of the possible locations for low frequency sub-channels. FIG. 11B shows the sub-set of the possible locations for high frequency sub-channels. The total number of active low and high frequency sub-channels sums to the desired number of active sub-channels, 20.

The objective function used $N_f$=16. 9 of the 16 discrete frequencies are unique since all the filter taps are real and therefore frequency responses are conjugate symmetric.

Figure 12A:
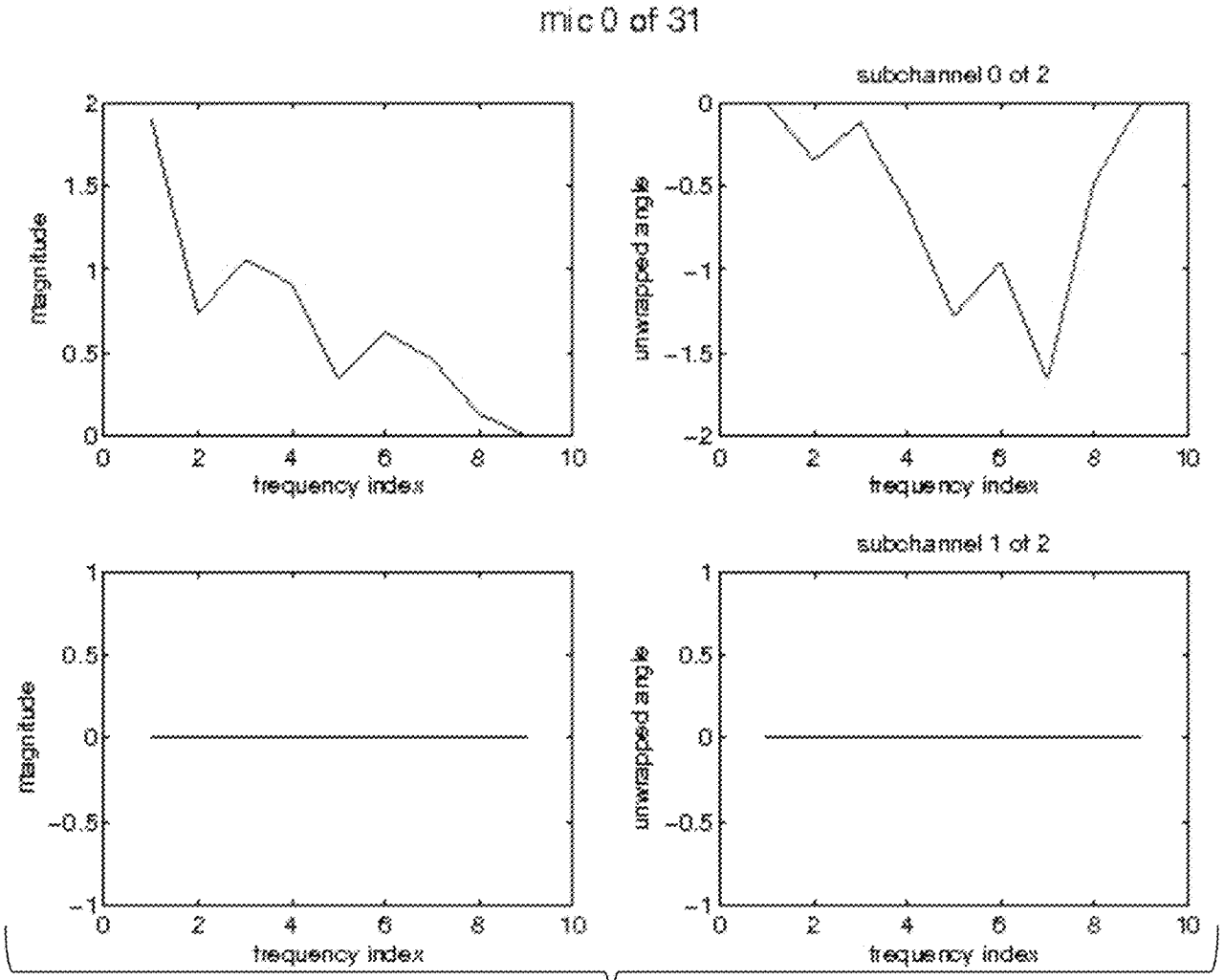
FIG. 12A shows an example frequency response for a synthesis filter in one of the microphones of FIG. 11A using only a low frequency synthesis filter.
Figure 12B:
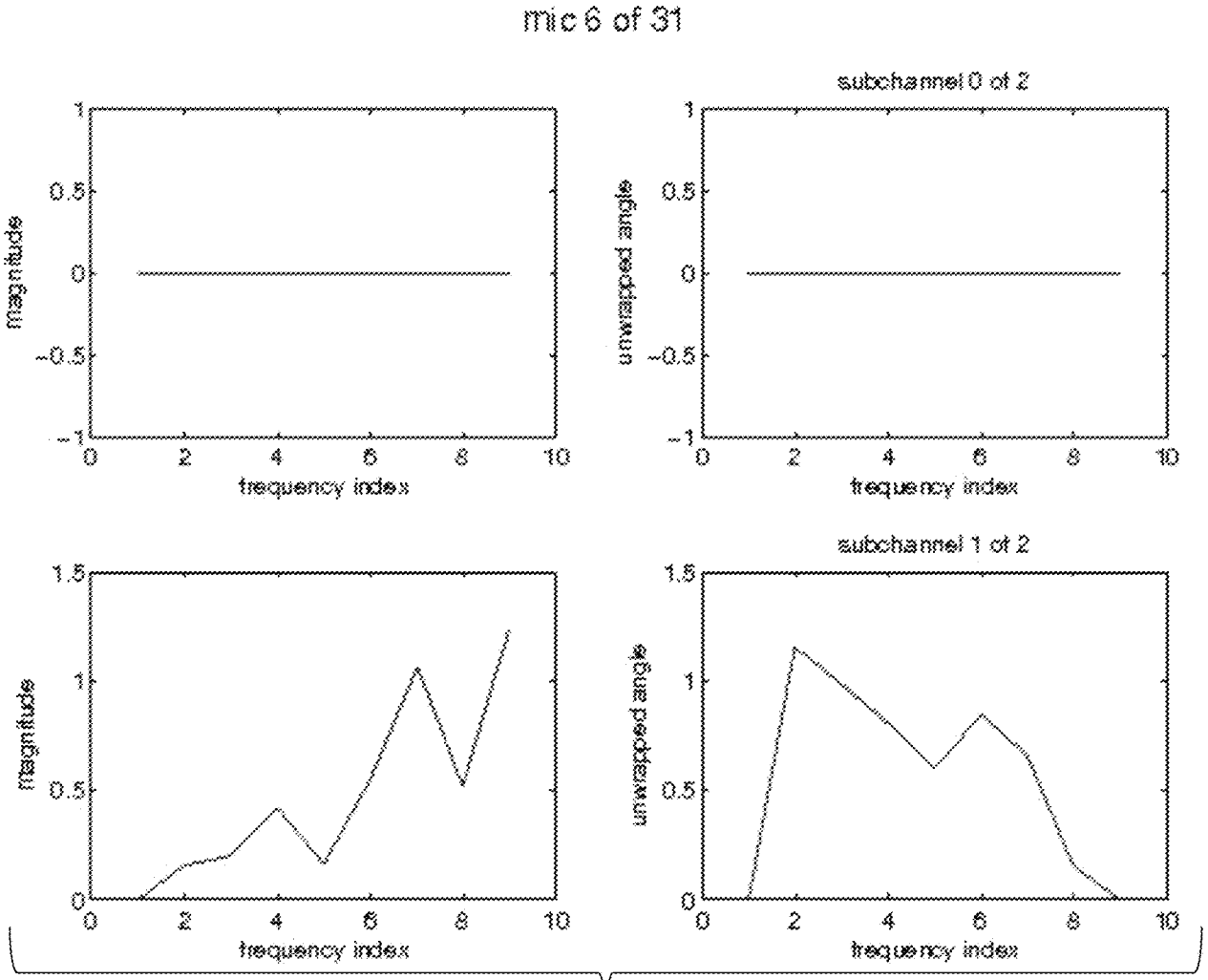
FIG. 12B shows an example frequency response for a synthesis filter in one of the microphones of FIG. 11B using only a high frequency synthesis filter.
Figure 12C:
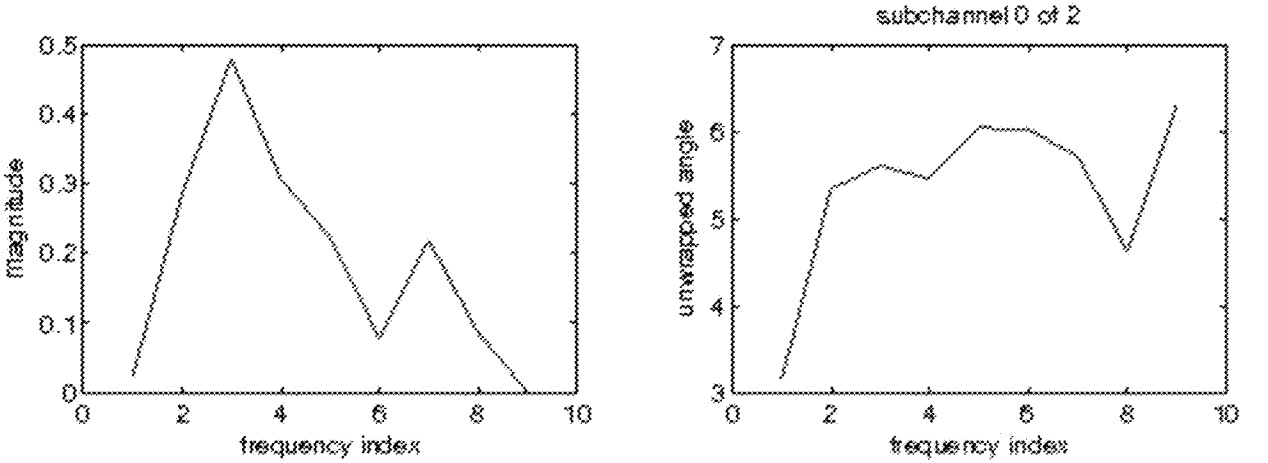
FIG. 12C shows example frequency responses for synthesis filters in one of the microphones of FIGS. 11A and 11B using both high and low frequency synthesis filters.
Figure 12C:
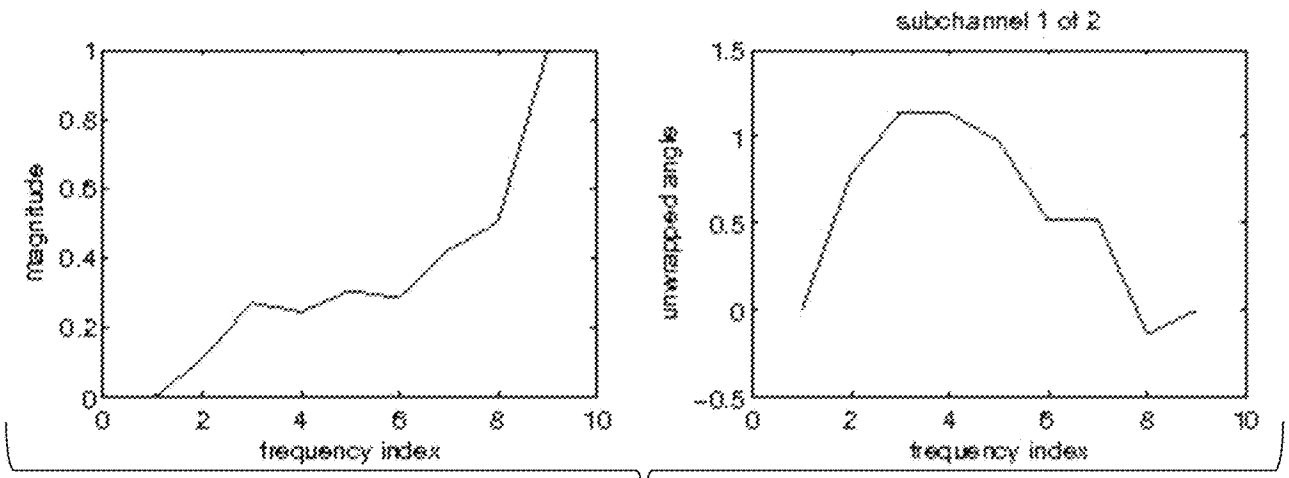

FIGS. 12A-C show example frequency responses for synthesis filters resulting from the optimization of the 64 sub-channels at 32 possible microphone locations where the optimization returns a selection of 20 sub-channels. FIG. 12A shows the frequency response for the multirate filter bank for the microphone labeled "0." This microphone has only the low frequency sub-channel active in this audio system. FIG. 12B shows the frequency response for the multirate filter bank for the microphone labeled "6." This microphone has only the high frequency sub-channel active in this audio system. FIG. 12C shows the frequency response for the multirate filter bank for the microphone labeled "29." This microphone has both the low and high frequency sub-channels active in this audio system.

Figure 8:
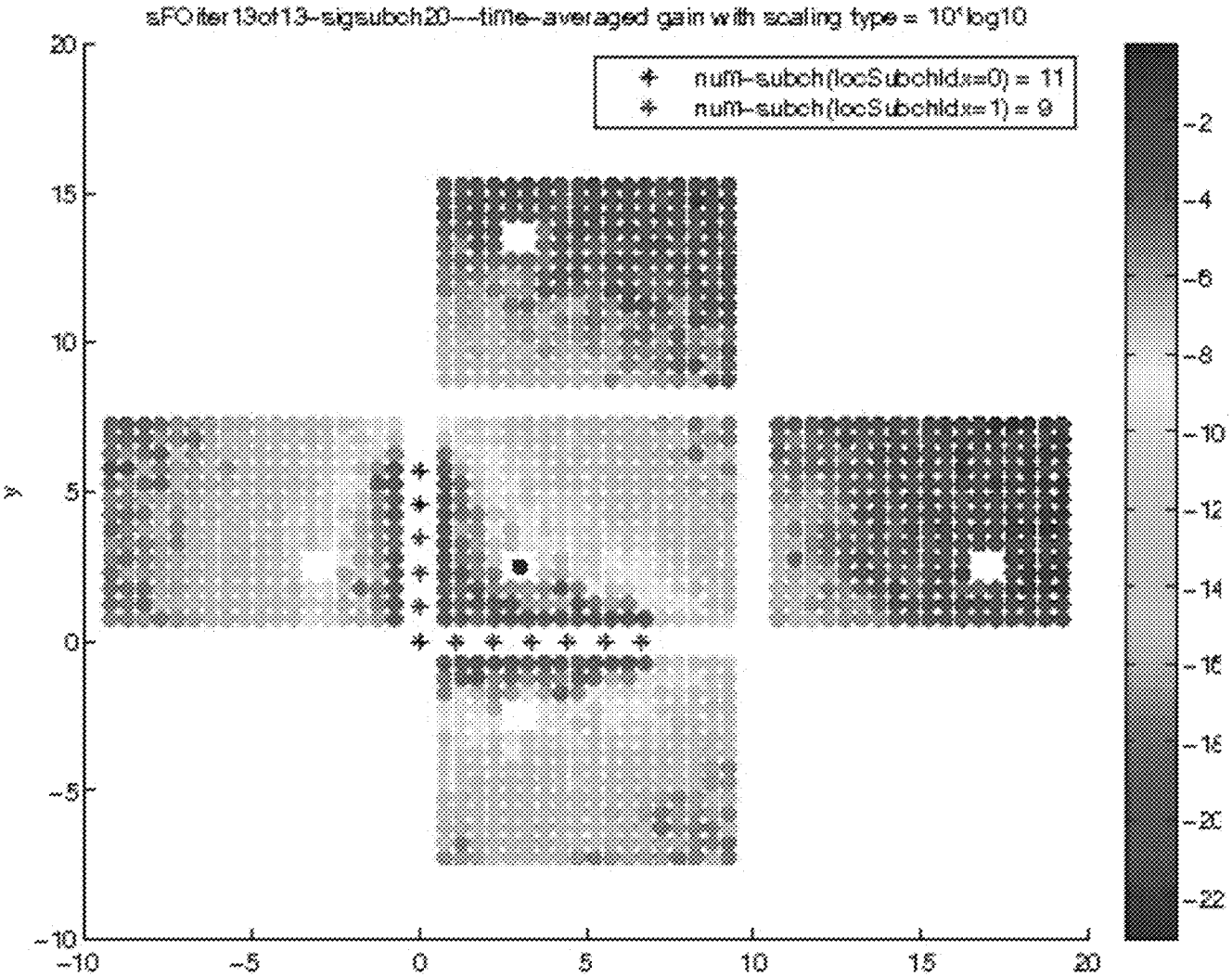
FIG. 8 is an example plot of performance resulting from optimization.

FIG. 8 shows a time averaged gain using the audio system resulting from the optimization. The time averaged gains show how the 20 synthesis filters resulting from the optimization performed on the set of sources of FIG. 1. The target gain is 0 dB because an optimization constraint was target perfect reconstruction. The worst interference gain is −8.27 dB. In a room with a denser set of interferences, the worst interference gain is 1.84 dB. Not surprisingly, the performance is worst near the microphones. The target gain is again 0 dB, and the gain map decays very smoothly.

While there have been shown, described and pointed out fundamental novel features of the invention as applied to preferred embodiments thereof, it will be understood that various omissions and substitutions and changes in the form and details of the methods and systems illustrated and in its operation may be made by those skilled in the art without departing from the spirit of the invention. It is the intention, therefore, to be limited only as indicated by the scope of the claims.

The invention claimed is:

1. A method to place microphones and design filters in a microphone network, the method comprising:

determining possible locations for the microphones of an array of the microphone network in a region;

assigning two or more sub-channels for each of the possible locations and a filter for each of the sub-channels;

for a target source in the region, solving for a sub-set of the possible locations and filter responses for the filters of the sub-channels of the sub-set, the solving for the sub-set of the possible locations and the filter responses for the sub-set being simultaneous; and linking the filter responses for the sub-set to the microphones at the possible locations of the sub-set.

2. The method of claim 1 wherein determining comprises determining the possible locations as locations of the microphones as existing in the region.

3. The method of claim 1 wherein determining comprises determining the possible locations as design locations for the microphones.

4. The method of claim 1 wherein assigning comprises assigning the filter as an analysis filter local to the microphone and a synthesis filter remote from the microphone.

5. The method of claim 1 wherein assigning the filter comprises assigning a FIR filter with a plurality of taps in a multirate filterbank, and wherein solving comprise solving for values of the taps of the FIR filter.

6. The method of claim 1 wherein assigning the two or more sub-channels comprises assigning the two or more as frequency divisions of a spectrum, the frequency divisions of each of the possible locations being the same.

7. The method of claim 1 wherein solving comprises solving as a convex optimization.

8. The method of claim 1 wherein solving comprises solving as a function a first term that is a p-norm of a gain of interferences from interference sources and a second term that is a penalty for the sub-channels.

9. The method of claim 8 wherein solving as a function of the first term comprises solving with the interferences modeled as white noise.

10. The method of claim 8 wherein solving simultaneously comprises solving as a function of the first and second terms, and further comprising solving for the filter responses again with the penalty set to zero.

11. The method of claim 8 wherein solving comprises solving with the first and second terms each being a function of the filter responses.

12. The method of claim 8 wherein solving as a function of the second term comprises iterating with different values of a constant until a number of sub-channels in the sub-set matches with a user input of a number of the sub-channels for the microphone network.

13. The method of claim 8 wherein solving as the function of the second term comprises solving with the penalty term comprising a count of the sub-channels with the respective frequency responses above a threshold, the sub-channels with the respective frequency response above the threshold being in the sub-set and the sub-channels with the respective frequency response below the threshold not being in the sub-set.

14. The method of claim 8 wherein solving as the function of the second term comprises solving as a function of a maximum of an absolute value of an infinity norm with discrete frequencies.

15. The method of claim 8 wherein solving comprises minimizing an objective function with the first and second terms subject to a constraint of target source perfect reconstruction.

16. The method of claim 1 wherein linking comprises linking the filter responses to the sub-channels at the possible locations of the sub-set.

17. The method of claim 1 further comprising repeating the solving for different target source locations.

18. The method of claim 1 further comprising filtering with filters configured by the filter responses signals from the microphones at the possible locations.

19. A system for placing microphones and designing filters, the system comprising:

a processor configured to:

determine possible locations for microphones of a microphone array in a region, assign two or more sub-channels for each of the possible locations and a filter for each of the sub-channels, and for a target source in the region, solve for a sub-set of the possible locations and filter responses for the filters of the sub-channels of the sub-set, the solution for the sub-set of the possible locations and the filter responses for the sub-set being simultaneous; and a memory configured to store the filter responses for the sub-set and the possible locations of the sub-set.

20. A system to filter microphone signals for a target source, the system comprising:

an acoustic beamformer, comprising:

a plurality of beamformer channels;

a plurality of microphones, each microphone assigned to a corresponding beamformer channel, each microphone having a location within an array of the plurality of microphones in a region;

a plurality of first filters, wherein each of the first filters is coupled to one of the plurality of microphones, each first filter having a frequency response based at least in part on the type of the respective microphone, and each first filter generating a filtered sub-channel;

a plurality of second filters, each of the second filters configured to filter a corresponding filtered sub-channel from a respective first filter, wherein second filter responses of the second filters are based on from a simultaneous solution of a respective microphone location and a corresponding second filter response, wherein the simultaneous solution comprises solving as a function a first term that is a p-norm of a gain of interferences from interference sources and a second term that is a penalty for the sub-channels; and a summer configured to sum outputs from the second filters.

* * * * *